US008033632B2

(12) United States Patent
Koase

(10) Patent No.: US 8,033,632 B2
(45) Date of Patent: Oct. 11, 2011

(54) METHOD FOR ADJUSTING EJECTION TIMING AND EJECTION TIMING ADJUSTING APPARATUS

(75) Inventor: Takashi Koase, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 625 days.

(21) Appl. No.: 11/959,359

(22) Filed: Dec. 18, 2007

(65) Prior Publication Data

US 2008/0143770 A1 Jun. 19, 2008

(30) Foreign Application Priority Data

Dec. 19, 2006 (JP) ..... 2006-341513

(51) Int. Cl.
*B41J 29/393* (2006.01)

(52) U.S. Cl. ..... 347/19; 347/15

(58) Field of Classification Search ..... 347/19, 347/15

See application file for complete search history.

(56) References Cited

U.S. PATENT DOCUMENTS

| | | | | |
|---|---|---|---|---|
| 5,250,956 | A * | 10/1993 | Haselby et al. | 347/19 |
| 5,297,017 | A | 3/1994 | Haselby et al. | |
| 6,092,939 | A | 7/2000 | Nishikori et al. | |
| 6,137,592 | A | 10/2000 | Arquilevich et al. | |
| 6,241,334 | B1 | 6/2001 | Haselby | |
| 6,254,218 | B1 | 7/2001 | Suzuki et al. | |
| 6,568,784 | B2 | 5/2003 | Izumi et al. | |
| 7,258,429 | B2 | 8/2007 | Takahashi et al. | |
| 2002/0130915 | A1 | 9/2002 | Izumi et al. | |
| 2005/0052494 | A1 * | 3/2005 | Takahashi et al. | 347/41 |

FOREIGN PATENT DOCUMENTS

| | | |
|---|---|---|
| EP | 0540243 A2 | 5/1993 |
| EP | 0869007 A2 | 10/1998 |
| EP | 0931671 A2 | 7/1999 |
| JP | 10-329381 | 12/1998 |

OTHER PUBLICATIONS

European search report for corresponding European application 07254943.9-1251 lists the references above.

* cited by examiner

*Primary Examiner* — Laura Martin
(74) *Attorney, Agent, or Firm* — DLA Piper LLP (US)

(57) ABSTRACT

The invention relates to a method for adjusting ejection timing including forming adjustment patterns on a medium by shifting relative ejection timings of liquid droplets from a first nozzle row and a second nozzle row lined up in a direction intersecting a row direction in which nozzles of the first nozzle row and the second nozzle row are lined up, while shifting relative positions of the first nozzle and the second nozzle, and the medium in the intersecting direction; and determining adjustment amounts of relative ejection timings of the first nozzle row and the second nozzle row based on the adjustment patterns, wherein the adjustment patterns are formed in the intersecting direction in a plural number separated from each other by a predetermined distance, and the ejection timing is adjusted based on an average of the adjustment amounts determined based on the adjustment patterns.

17 Claims, 20 Drawing Sheets

100

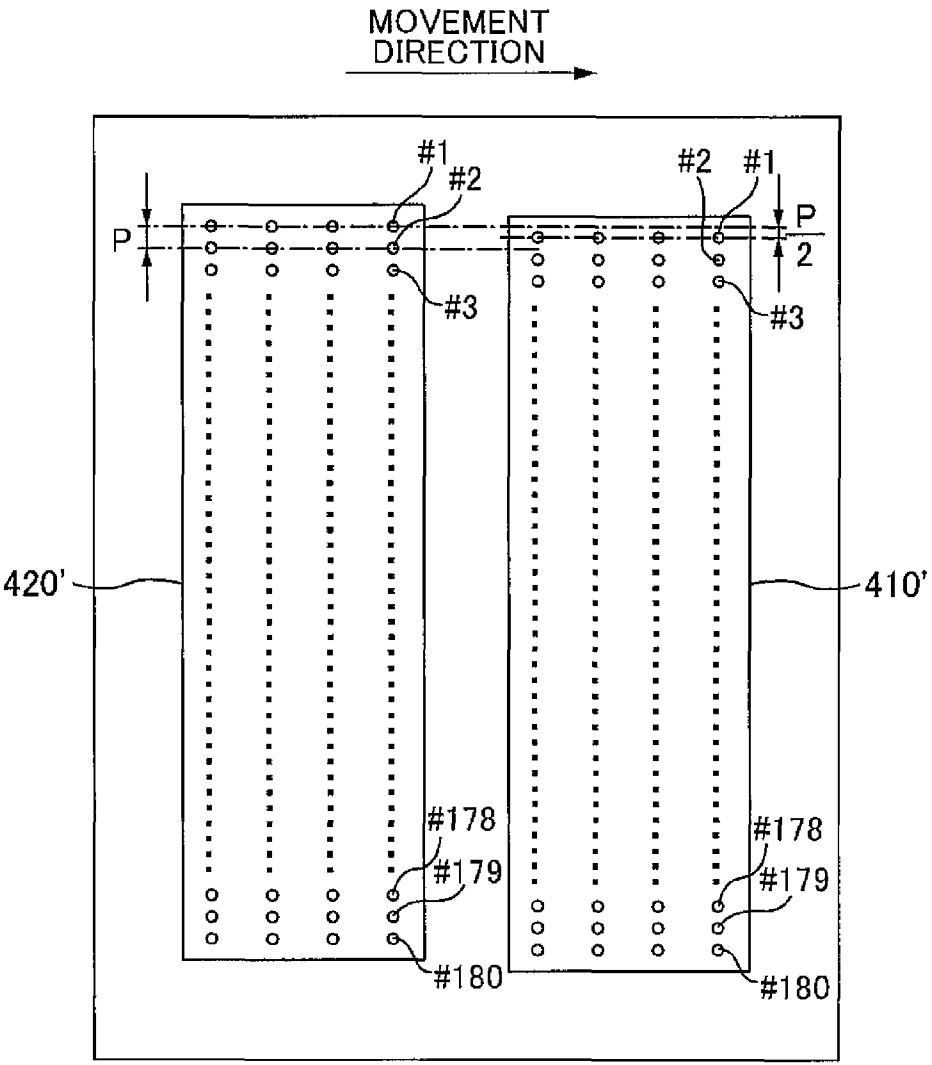
FIG. 20
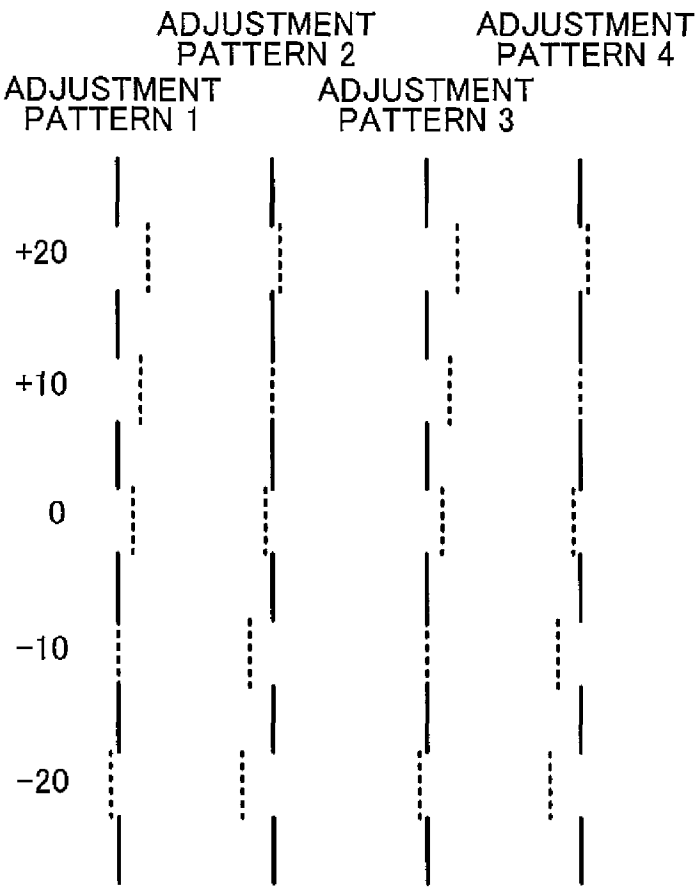

METHOD FOR ADJUSTING EJECTION TIMING AND EJECTION TIMING ADJUSTING APPARATUS

CROSS-REFERENCE TO RELATED APPLICATIONS

The present application claims priority upon Japanese Patent Application No. 2006-341513 filed on Dec. 19, 2006, which is herein incorporated by reference.

BACKGROUND

1. Technical Field

The present invention relates to methods for adjusting ejection timing and ejection timing adjusting apparatuses.

2. Related Art

There are printers having two heads disposed lined up in a direction intersecting a row direction in which nozzles of nozzle rows are lined up. These two heads are disposed such that the position of one of the heads is shifted in the nozzle row direction by a distance corresponding to half a nozzle pitch. Through this, it is possible to double the resolution in the nozzle row direction. In order to perform printing using heads disposed in this manner, it is required to adjust in advance the landing positions of liquid droplets ejected from those two heads with respect to a transport direction.

A method has been used in order to adjust the landing position in the transport direction; an adjustment pattern, in which the ejection timings of liquid droplets ejected from a first head and a second head are shifted by small degrees, is printed, and then the optimal ejection timing of the liquid droplets is selected so as to carry out necessary adjustment (JP-A-10-329381).

However, when a roller for transporting paper is decentered or the like, the transport amount of paper varies when paper is transported. Then, such variance in the transport amount due to such decentering causes a transport error.

Forming an adjustment pattern and adjusting the ejection timing of liquid droplets based thereon results in adjustment of the ejection timing of liquid droplets based on the adjustment pattern formed while affected by a transport error. The transport error is composed of a consistent error component and an error component that periodically varies, the components being combined. It is difficult to determine the amount of the error component that periodically varies while the pattern is recorded. Therefore, it is impossible to properly adjust the ejection timing due to the indeterminable varying component contained in the transport error.

SUMMARY

The invention has been achieved to address the above-described circumstances, and has an advantage of enabling proper adjustment of the ejection timing of liquid droplets ejected from a plurality of heads.

A primary aspect of the invention in order to achieve the above-described advantage is:

A method for adjusting ejection timing including:

forming adjustment patterns on a medium by shifting relative ejection timings of liquid droplets from a first nozzle row and a second nozzle row lined up in a direction intersecting a row direction in which nozzles of the first nozzle row and the second nozzle row are lined up, while shifting relative positions of the first nozzle and the second nozzle, and the medium in the intersecting direction; and determining adjustment amounts of relative ejection timings of the first nozzle row and the second nozzle row based on the adjustment patterns, wherein the adjustment patterns are formed in the intersecting direction in a plural number separated from each other by a predetermined distance, and the ejection timing is adjusted based on an average of the adjustment amounts determined based on the adjustment patterns.

Features and advantages of the invention other than the above will become clear by reading the description of the present specification with reference to the accompanying drawings.

BRIEF DESCRIPTION OF THE DRAWINGS

For a more complete understanding of the invention and the advantages thereof, reference is now made to the following description taken in conjunction with the accompanying drawings wherein:

FIG. 20 is a diagram describing the relation of a first head 410', a second head 420' and a plurality of adjustment patterns printed on paper according to the second embodiment.

DESCRIPTION OF EXEMPLARY EMBODIMENTS

Figure 1:
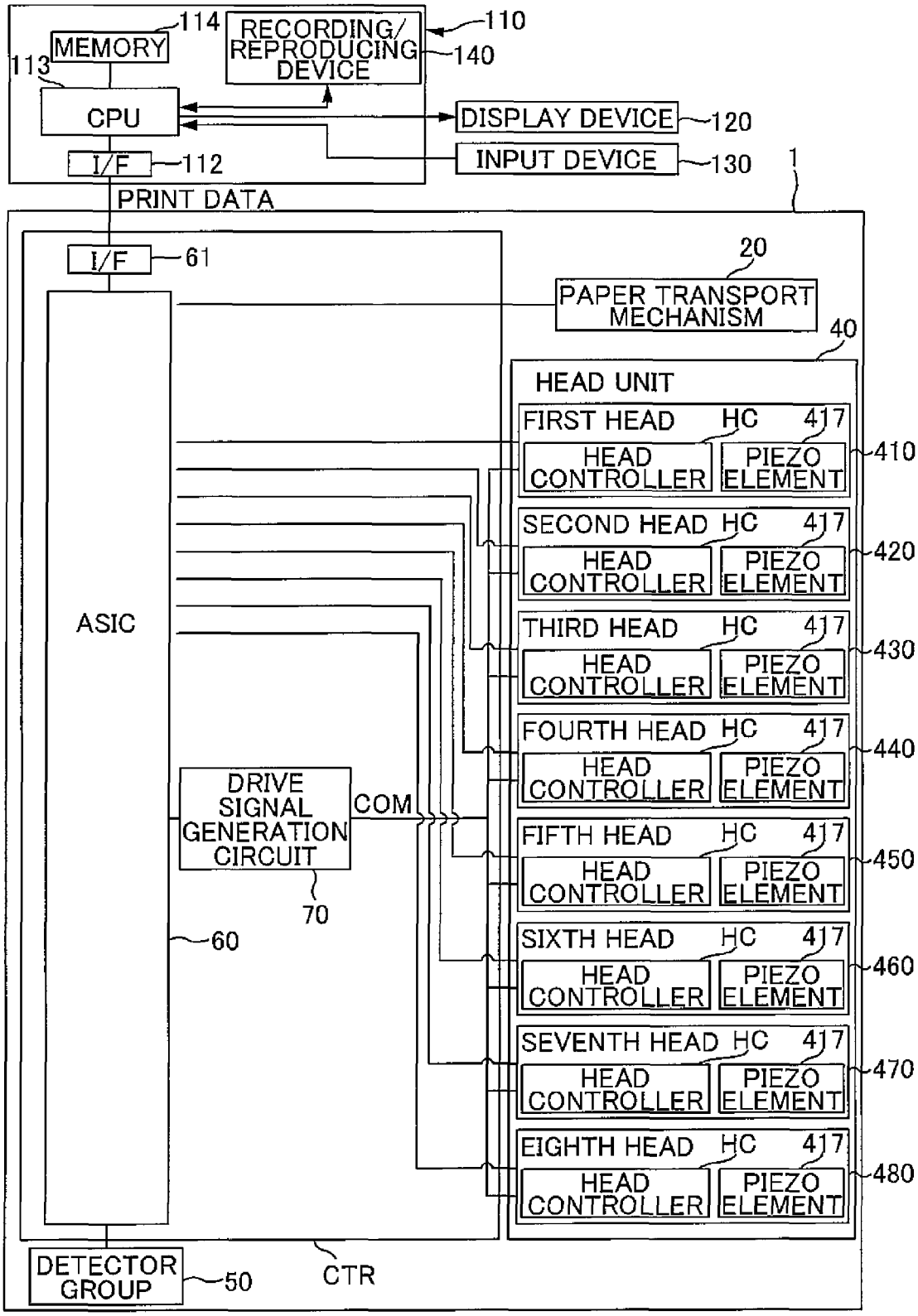
FIG. 1 is a block diagram of the overall configuration of a printing system according to a first embodiment.

At least the following matters will be made clear by reading the description of the present specification with reference to the accompanying drawings.

A method for adjusting ejection timing including:

forming adjustment patterns on a medium by shifting relative ejection timings of liquid droplets from a first nozzle row and a second nozzle row lined up in a direction intersecting a row direction in which nozzles of the first nozzle row and the second nozzle row are lined up, while shifting relative positions of the first nozzle and the second nozzle, and the medium in the intersecting direction; and determining adjustment amounts of relative ejection timings of the first nozzle row and the second nozzle row based on the adjustment patterns, wherein the adjustment patterns are formed in the intersecting direction in a plural number separated from each other by a predetermined distance, and the ejection timing is adjusted based on an average of the adjustment amounts determined based on the adjustment patterns.

Through this, the ejection timing of liquid droplets ejected from a plurality of heads can be properly adjusted.

In such a method for adjusting ejection timing, it is preferable that the predetermined distance corresponds to a circumferential length obtained when a rotating member for shifting the relative position has performed a half rotation. Also, it is preferable that the adjustment patterns are formed in an even number, and the ejection timing is adjusted based on the average of the adjustment amounts determined based on the adjustment patterns in an even number. It is preferable that the rotating member is a transport roller for transporting the medium in the intersecting direction, and the relative position is shifted by rotating the transport roller and transporting the medium. Further, it is preferable that the rotating member is a roller for moving the first nozzle row and the second nozzle row in the intersecting direction, and the relative position can be shifted by rotating the roller and moving the first nozzle row and the second nozzle row.

Also, it is preferable that with respect to the direction of the first nozzle row, each nozzle of the first nozzle row is positioned at the center of two nozzles of the second nozzle row. It is preferable that the adjustment patterns are formed in a manner in which the landing position of liquid droplets from the second nozzle row is shifted in the intersecting direction with respect to the landing position of liquid droplets from the first nozzle row, as a result of the ejection timing of liquid droplets from the second nozzle row being shifted for each nozzle. Further, it is preferable that the adjustment patterns are formed in a manner in which ink droplets ejected from a predetermined number of nozzles of the first nozzle row and ink droplets ejected from a predetermined number of nozzles of the second nozzle row alternately land with respect to the first nozzle row direction.

Through this, the ejection timing of liquid droplets ejected from a plurality of heads can be properly adjusted.

An ejection timing adjusting apparatus, including:

a recording device that forms adjustment patterns on a medium by shifting relative ejection timings of liquid droplets from a first nozzle row and a second nozzle row lined up in an intersecting direction in which nozzles of the first nozzle row and the second nozzle row are lined up, while shifting relative positions of the first nozzle row and the second nozzle row, and the medium in the intersecting direction; and an input device that inputs adjustment amounts of an ejection timing of the first nozzle row and the second nozzle row based on the adjustment patterns, wherein the adjustment patterns are formed in the intersecting direction in a plural number separated from each other by a predetermined distance, and the apparatus further includes an arithmetic processing section that obtains the ejection timing based on an average of the adjustment amounts inputted based on the adjustment patterns.

Through this, the ejection timing of liquid droplets ejected from a plurality of heads can be properly adjusted.

A computer program for causing an ejection timing adjusting apparatus to operate, the program causing the ejection timing adjusting apparatus to carry out:

forming adjustment patterns on a medium by shifting relative ejection timings of liquid droplets from a first nozzle row and a second nozzle row lined up in a direction intersecting the row direction in which nozzles of the first nozzle row and the second nozzle row are lined up, while shifting relative positions of the first nozzle and the second nozzle, and the medium in the intersecting direction, and determining adjustment amounts of relative ejection timings of the first nozzle row and the second nozzle row based on the adjustment patterns, wherein the adjustment patterns are formed in a plural number in the intersecting direction separated from each other by a predetermined distance, and the ejection timing is adjusted based on the average of the adjustment amounts determined based on the adjustment patterns.

Through this, the ejection timing of liquid droplets ejected from a plurality of heads can be properly adjusted.

Overall Configuration

FIG. 1 is a block diagram of the overall configuration of a printing system. A printing system 100 is provided with a printer 1, a computer 110, a display device 120, and an input device 130. In the first embodiment, the printer 1 is an ink ejecting type line printer that prints images on a medium such as paper, cloth, or film. The configuration of the printer 1 is discussed in detail later.

The computer 110 is provided with a CPU 113, a memory 114, an interface 112, and a recording/reproducing device 140. The CPU 113 executes various programs such as a printer driver, and for example carries out image processing on images to be printed by the printer 1, which is discussed later. The memory 114 stores programs such as a printer driver and data. The interface 112 is an interface such as USB or a parallel interface for connecting to the printer 1. The recording/reproducing device 140 is a device such as a CD-ROM drive or a hard disk drive for storing programs and data.

The computer 110 is communicably connected to the printer 1 via the interface 112, and outputs print data corresponding to an image that is to be printed, to the printer 1 in order to cause the printer 1 to print that image.

A printer driver is installed on the computer 110. The printer driver is a program for causing the display device 120 to display a user interface and for converting image data outputted from an application program to print data.

Regarding Configuration of the Printer

Figure 2A:
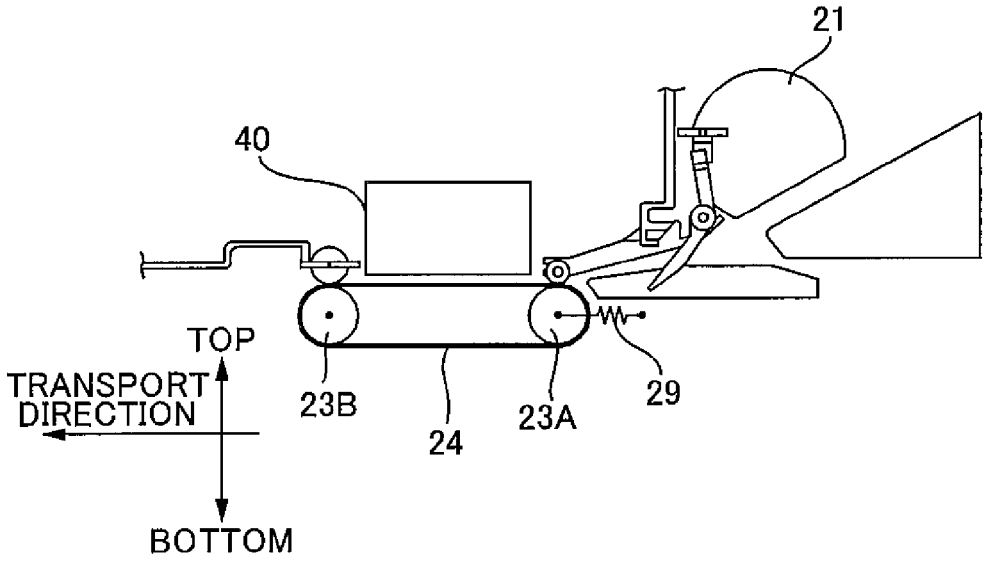
FIG. 2A is a cross-sectional view of a printer 1.
Figure 2B:
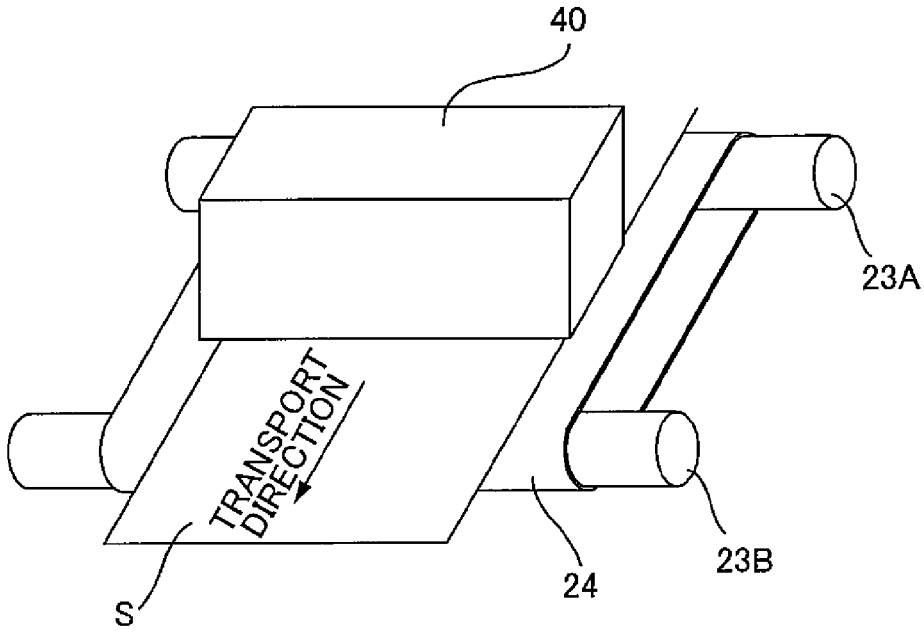
FIG. 2B is a perspective view describing a process for transporting a paper S of the printer 1.

FIG. 2A is a cross-sectional view of the printer 1. Furthermore, FIG. 2B is a perspective view describing a process for transporting paper S of the printer 1. The basic configuration of a line printer is described below with reference to FIG. 1 as well.

The printer 1 has a paper transport mechanism 20, a head unit 40, a detector group 50, an ASIC 60, and a drive signal generation circuit 70. The printer 1 receives print data from the computer 110. Then, based on the received data, the ASIC 60 of the printer 1 controls various sections of the printer 1 (the paper transport mechanism 20, the head unit 40, and the drive signal generation circuit 70) to print an image on the paper S.

The status of the printer 1 is monitored by the detector group 50. The detector group 50 outputs detection results to the ASIC 60. Then, based on these detection results, the ASIC 60 controls the various sections.

The paper transport mechanism 20 is for transporting a medium (such as the paper S) in a predetermined direction (hereinafter referred to as a "transport direction"). The paper transport mechanism 20 has a paper feed roller 21, a transport motor (not shown), an upstream-side transport roller 23A, a downstream-side transport roller 23B, and a belt 24. The paper feed roller 21 is a roller for feeding paper S that has been inserted into a paper insert opening into the printer. The downstream-side transport roller 23B is connected to an unshown transport motor. When this transport motor rotates, the downstream-side transport roller 23B also rotates. Then, the belt 24 rotates as well along with the rotation of the downstream-side transport roller 23B, which further rotates the upstream-side transport roller 23A. The rotation of the unshown transport motor is controlled by the ASIC 60. A spring 29 is attached to the upstream-side transport roller 23A. The upstream-side transport roller 23A is capable of moving in the horizontal direction by a slight amount so as to prevent sagging of the belt 24.

The paper S that has been fed by the paper feed roller 21 is transported by the belt 24 up to a printable area (an area opposed to the heads). When the belt 24 transports the paper S, the paper S moves in the transport direction with respect to the head unit 40. The paper S that has passed through the printable area is discharged to the outside by the belt 24. It should be noted that the paper S during transport is electrostatically-adhered or vacuum-adhered to the belt 24.

The head unit 40 is for ejecting ink droplets onto the paper S. By ejecting ink droplets onto the paper S being transported, the head unit 40 forms dots on the paper S, thereby printing an image on the paper S. The printer 1 is a line printer and, as is described later, the head unit 40 has eight heads, a first head 410 to an eighth head 480. The configuration of the head unit 40 is described in detail later.

The detection group 50 includes a rotary encoder (not shown) or the like. The rotary encoder detects the rotation amount of the upstream-side transport roller 23A and the downstream-side transport roller 23B. Based on the detection results of the rotary encoder, the ASIC 60 can detect a transport amount of the paper S, and thereby can control transport of paper S by a predetermined amount.

The ASIC 60 is a control unit for controlling the printer 1. The ASIC 60 is connected to an interface section 61 inside the printer 1 and can communicate with the computer 110. The ASIC 60 has a function of carrying out arithmetic processing for performing the overall control of the printer. Furthermore, the ASIC 60 includes a memory for storing programs and data. It also controls various mechanisms in accordance with the programs stored in the memory.

The drive signal generation circuit 70 is a circuit that generates drive signals that are applied to piezo elements 417 inside the heads, which are described later, so as to cause ink droplets to be ejected from the nozzles. The drive signal generation circuit 70 outputs drive signals to the head unit 40 based on waveform data outputted from the ASIC 60. The drive signal is a signal that includes a plurality of driving pulses during a predetermined period T. The driving pulse is a pulse that is selectively applied to a piezo element 417 so as to cause an ink droplet to be ejected. The drive signal is repeatedly generated and outputted from the drive signal generation circuit 70.

Regarding Configuration of Head Unit

Referring to FIG. 1 again, each head of the head unit 40 has a head controller HC. Furthermore, the driving pulse applied to the piezo element 417 of each nozzle is selected under the control of the head controller HC. Ink droplets are ejected from the individual nozzles due to the application of the driving pulses to the piezo elements 417. The head controller HC is controlled by the ASIC 60. Through this, the ejection timing can be shifted for each nozzle by the ASIC 60.

Figure 3:
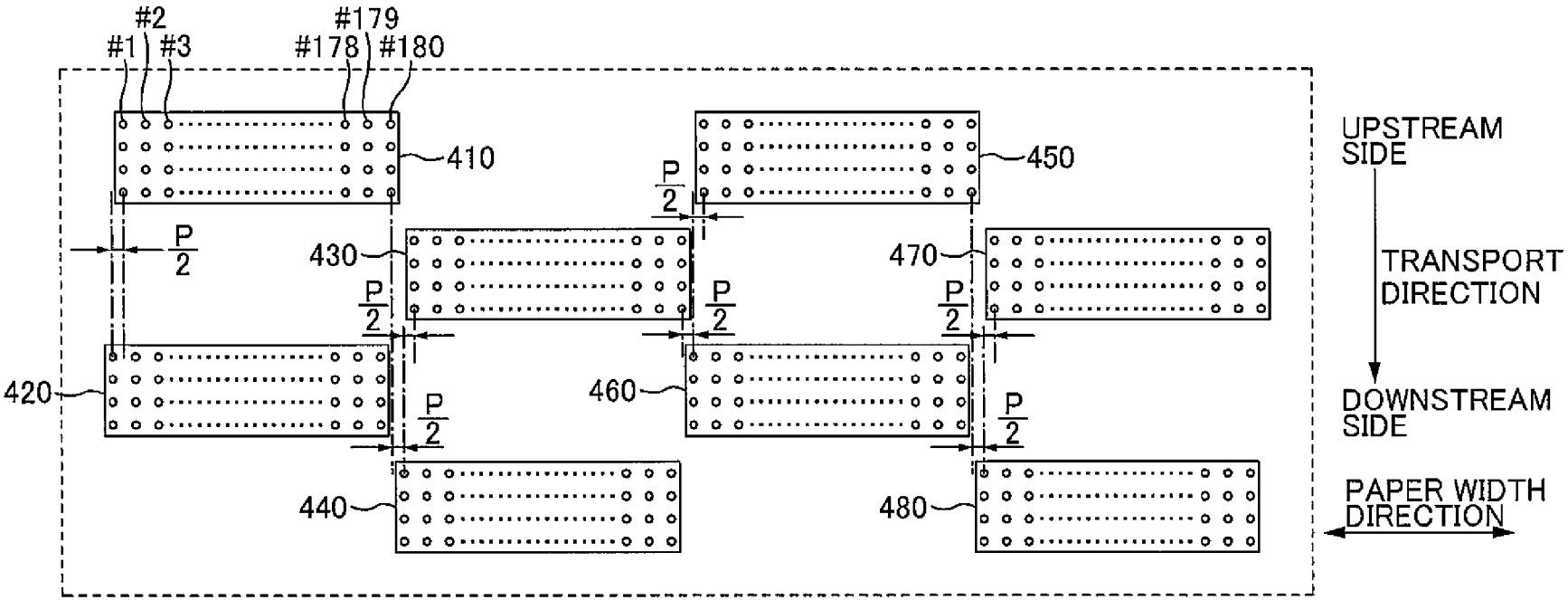
FIG. 3 is a diagram describing the detailed layout of eight heads of a head unit 40.

FIG. 3 is a diagram describing the detailed layout of the eight heads of the head unit 40. FIG. 3 shows the first head 410 to the eighth head 480 as viewed from above the printer 1. When viewed from above the printer 1, these nozzles are hidden by other components and cannot be seen. However, here the positions of the nozzles are drawn with solid lines to facilitate understanding of a relation among the nozzles of the first head 410 to the eighth head 480.

The head unit 40 includes eight heads, the first head 410 to the eighth head 480. These heads are disposed such that the direction intersecting the nozzle row direction corresponds to the paper transport direction. Each head includes four nozzle rows so as to eject four colors of ink droplets. The distance between nozzles in the nozzle rows (nozzle pitch P) is $1/180$ inch. For each color, 180 nozzles and piezo elements 417 for causing these nozzles to eject ink droplets are provided. The piezo element 417 is provided to each nozzle independently.

Here, two heads lined up in the transport direction is disposed so as to be shifted from each other by half the nozzle pitch (P/2) in the direction intersecting the paper transport direction (paper width direction). For example, as regards the first head 410 and the second head 420, the second head 420 is disposed shifted by P/2 in the paper width direction with respect to the first head 410. Specifically, the nozzle #1 of the first head 410 is disposed so as to be positioned between the nozzle #1 and the nozzle #2 of the second head 420. That is, each nozzle of the first head 410 is positioned at the center of two nozzles of the second head 420. In this manner, a resolution of 360 dpi is realized in the paper width direction with the first head and the second head.

In a similar manner, the fourth head 440 is disposed shifted by P/2 in the paper width direction (to the left of FIG. 3) with respect to the third head 430. Also, the sixth head 460 is disposed shifted by P/2 in the paper width direction (to the left of FIG. 3) with respect to the fifth head 450. The eighth head 480 is disposed shifted by half the nozzle pitch (P/2) in the paper width direction (to the left of FIG. 3) with respect to the seventh head 470. That is, with respect to the nozzle row direction, each nozzle of the third head 430 is positioned at the center of two nozzles of the fourth head 440. Similarly, with respect to the nozzle row direction, each nozzle of the fifth head 450 is positioned at the center of two nozzles of the sixth head 460, and each nozzle of the seventh head 470 is positioned at the center of two nozzles of the eighth head 480.

The third head 430 is disposed on the downstream side in the transport direction with respect to the first head 410. And with respect to the paper width direction, the nozzle #180 of the first head 410 and the nozzle #1 of the third head 430 are disposed so as to have a nozzle pitch P. In a similar manner, the seventh head 470 is disposed on the downstream side in the transport direction with respect to the fifth head 450. And with respect to the paper width direction, the nozzle #180 of the fifth head 450 and the nozzle #1 of the seventh head 470 are disposed so as to have a nozzle pitch P. The first head 410 and the fifth head 450 are disposed at the same position with respect to the transport direction, and the third head 430 and the seventh head 470 are disposed at the same position with respect to the transport direction.

The second head 420 is disposed on the downstream side in the transport direction with respect to the third head 430. The fourth head 440 is disposed on the downstream side in the transport direction with respect to the second head 420. These heads are disposed such that with respect to the paper width direction, the nozzle #180 of the second head 420 and the nozzle #1 of the fourth head 440 are disposed so as to have a nozzle pitch P. Similarly, the eighth head 480 is disposed on the downstream side in the transport direction with respect to the sixth head 460. And with respect to the paper width direction, the nozzle #180 of the sixth head 460 and the nozzle #1 of the eighth head 480 are disposed shifted from each other so as to have a nozzle pitch P. The second head 420 and the sixth head 460 are disposed at the same position with respect to the transport direction, and the fourth head 440 and the eighth head 480 are disposed at the same position with respect to the transport direction.

In this manner, printing at a resolution of 360 dpi in the paper width direction can be performed on paper transported in the transport direction, using the first head 410 to the eight head 480.

Figure 4:
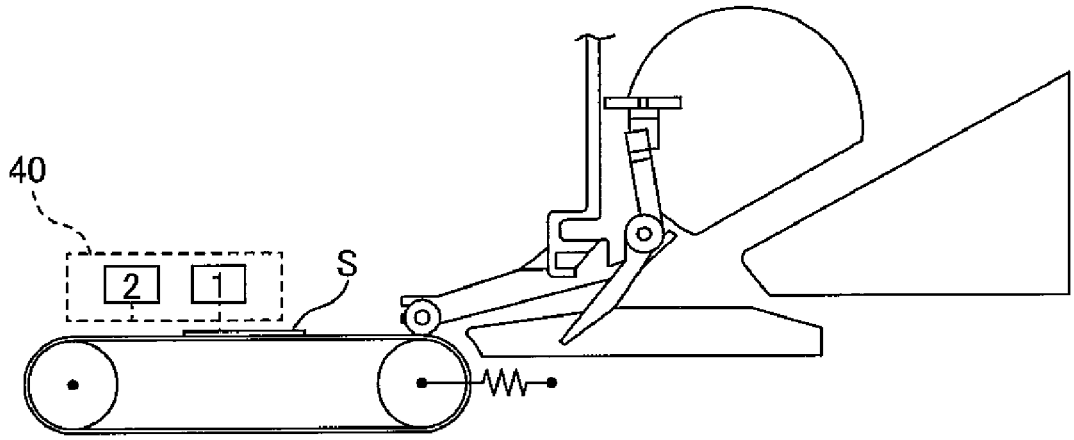
FIG. 4 shows a state, in which liquid droplets are ejected onto a paper that is transported.

FIG. 4 shows a state, in which liquid droplets are ejected onto paper that is transported. FIG. 4 shows a state in which ink droplets are ejected to form an image with the first head 410 and the second head 420, while the paper is transported in the transport direction. Here, only the first head 410 and the second head 420 are shown in order to simplify the description. Although not shown in FIG. 4, similarly, image formation is possible in a predetermined range in the paper width direction with the third head 430 and the fourth head 440. Also, image formation is possible in a predetermined range in the paper width direction with the fifth head 450 and the sixth head 460. Also, image formation is possible in a predetermined range in the paper width direction with the seventh head 470 and the eighth head 480.

The first head 410 and the second head 420 are disposed so as to overlap each other with respect to the paper transport direction. As described above, the nozzle pitch of each head is 180 dpi. Nozzles of these two heads are disposed such that the nozzles of one head are positioned between the nozzles of the other head. In order to realize a resolution of 360 dpi with these heads, it is required to adjust the ejection timing of ink droplets such that the landing position of ink droplets ejected by the first head 410 and that of ink droplets ejected by the second head 420 match with respect to the paper transport direction. An adjustment pattern described below, for example, can be used for adjusting the ejection timing.

Adjustment Pattern of Reference Example

Figure 5:
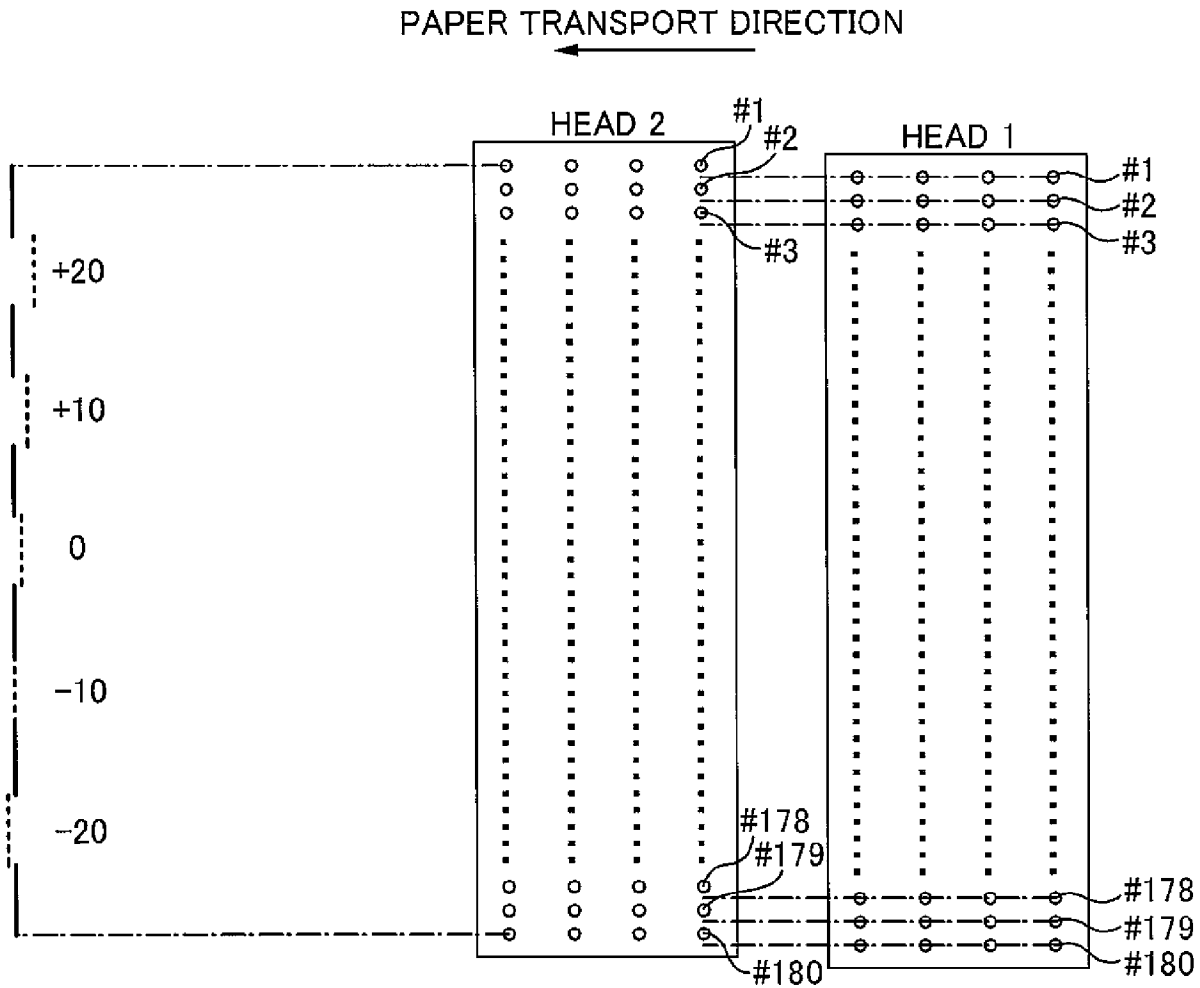
FIG. 5 is a diagram describing an adjustment pattern formed by ink droplets ejected from two heads.

FIG. 5 is a diagram describing an adjustment pattern formed with ink droplets ejected from two heads. Only the first head 410 and the second head 420 are shown in FIG. 5 in order to simplify the description. Although not shown in FIG. 5, a similar adjustment pattern can be formed by combining the third head 430 and the fourth head 440, the fifth head 450 and the sixth head 460, and the seventh head 470 and the eighth head 480.

Each head includes a black ink nozzle row K, a cyan ink nozzle row C, a magenta ink nozzle row M and a yellow ink nozzle row Y. Here, the description is given assuming that only the black ink nozzle row K is used. It should be noted that the black ink nozzle row K of the first head 410 corresponds to the first nozzle row, and the black ink nozzle row K of the second head 420 corresponds to the second nozzle row.

The adjustment pattern is shown on the downstream side in the transport direction of the head. The adjustment pattern is formed as a result of ink droplets being ejected from the respective nozzles of the first head 410 and the second head 420. In the adjustment pattern shown in FIG. 5, the solid line represents the adjustment pattern formed with the first head 410 (first line) and the dashed line represents the adjustment pattern formed with the second head 420 (second line). Although the second line is depicted with the dashed line so as to be distinguished from the first line, actually, it is a solid line. In this manner, the adjustment pattern is formed such that the first line and the second line are arranged in alternation in the paper width direction.

The ejection timing of the first lines is adjusted such that the first lines are on a straight line in the paper width direction. On the other hand, the second lines are formed so as to be gradually shifted in the paper transport direction. For this purpose, the ejection timing from the nozzles of the second head 420 is shifted by small degrees. A figure is indicated next to each second line. Each figure is the adjustment amount indicating for the second line next thereto, i.e., the amount (μm) by which the printer intended to shift the second line to the upstream side in the transport direction with respect to the first line when forming the second line. For example, "+20" means the ejection timing was controlled such that the printer 1 forms the second line shifted by 20 μm to the upstream side in the transport direction with respect to the first line. This adjustment amount can also be understood as indicating the shifted ejection timing. These adjustment amounts are not recorded on the paper in actuality, but they are shown in FIG. 5 for the convenience of description.

If the product is manufactured as designed, the second line formed with an adjustment amount of "0" is supposed to match the first line with respect to the paper transport direction. However, due to various errors in various sections of the printer 1, the second line formed with an adjustment amount of "0" sometimes does not match the first line with respect to the paper transport direction. Therefore, the ink droplet ejection timing is adjusted with reference to the adjustment amount of the adjustment pattern, so that the landing position of the ink droplets ejected from the first head 410 matches that of the ink droplets ejected from the second head 420 with respect to the transport direction.

For example, in the case of FIG. 5, the first line matches the second line with respect to the transport direction when the adjustment amount is "−10". Accordingly, by readjusting the ejection timing of the ink droplets ejected from the second head 420 to an earlier timing such that the ink droplets land at the position shifted by 10 μm to the downstream side, the landing position of the ink droplets ejected from the first head 410 can be matched to that of the ink droplets ejected from the second head 420 with respect to the transport direction.

Transport Error Caused by Decentering

Figure 6:
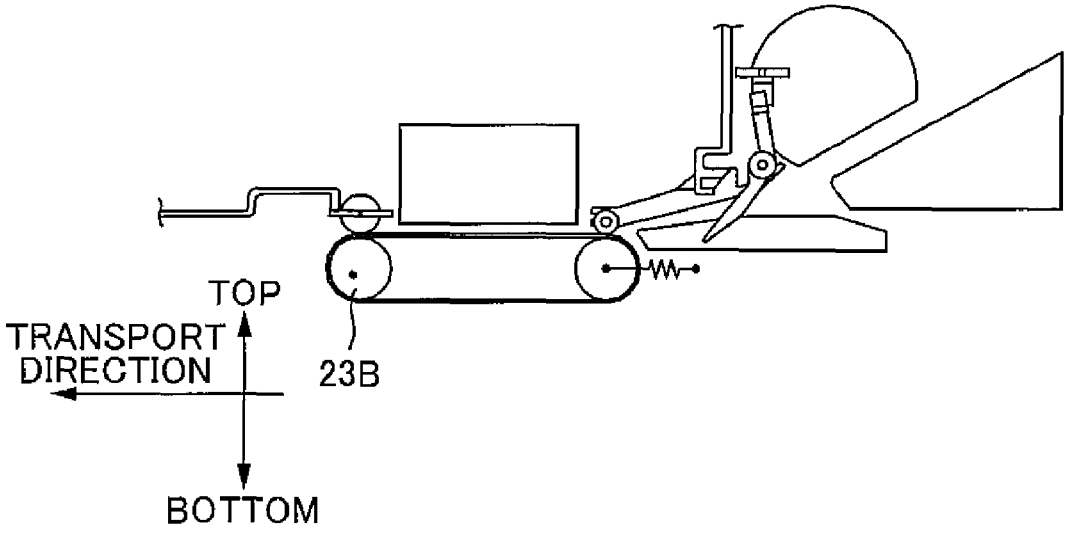
FIG. 6 is a diagram describing decentering of a transport roller 23B of the printer 1.

FIG. 6 is a diagram describing decentering of the transport roller 23B of the printer 1. As described above, the transport roller 23B is rotated as a result of an unshown transport motor rotating. Then, the belt 24 is moved as a result of the transport roller 23B rotating. This transport roller 23B corresponds to a rotating member that shifts the relative position of the first nozzle row and the second nozzle row, and the medium.

The transport roller 23B may be decentered due to variance in quality. When the transport roller 23B is decentered, the distance to the rotational center varies depending on the location on the circumferential surface of the transport roller 23B. Even if the rotation amount of the transport roller is the same, the transport amount varies depending on the location on the circumferential surface of the transport roller 23B.

The first head 410 and the second head 420 are disposed at a certain distance in the transport direction (referred to as a "head-to-head distance"). Therefore, in order for ink droplets to land on the same position with respect to the paper transport direction, transport by the head-to-head distance is required to be carried out after ejection of ink droplets from the first head 410 before ejection of the ink droplets from the second head 420. However, if the transport roller 23B is decentered as described above, the transport amount ends in varying. In that case, transport carried out after forming the first line before starting forming the second line is also affected by the variance in the transport amount, which causes a transport error. Then, even if the liquid ejection timing is adjusted based on the adjustment pattern, which is formed while affected by the transport error, correct adjustment of the ejection timing is impossible.

Figure 7A:
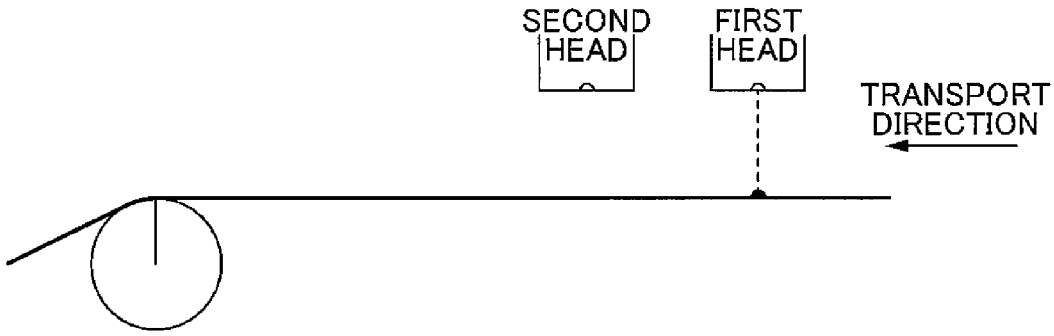
FIG. 7A is a diagram describing the state in which a first head forms a first line and then a second head forms a second line, when the transport roller 23B is not decentered.
Figure 7B:
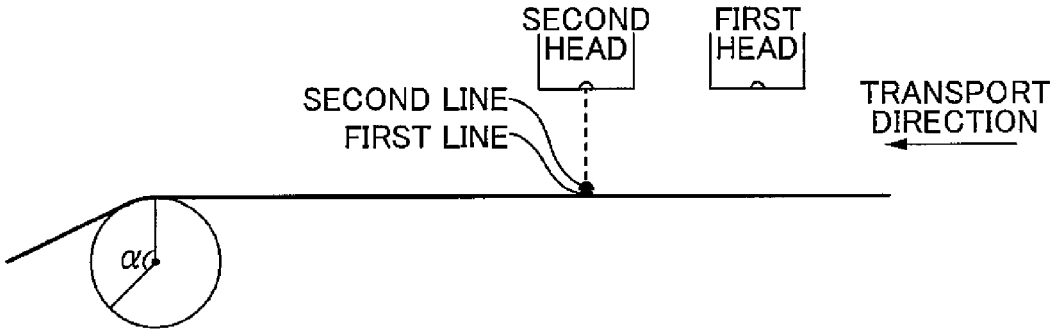
FIG. 7B is a diagram describing the state in which a first head forms a first line and then a second head forms a second line, when the transport roller 23B is not decentered.

FIGS. 7A and 7B are diagrams describing a state in which the first head forms the first line and thereafter the second head forms the second line, when the transport roller 23B is not decentered. In order to simplify the description, the first line and the second line formed with an adjustment amount of "0" are taken as an example.

In FIG. 7A, ink droplets are ejected from the first head to form the first line. Then, paper is transported. In FIG. 7B, when the transport roller 23B has rotated a predetermined angle α so as to match the first line and the second line with respect to the transport direction, ink droplets are ejected from the second head to form the second line. In this case, the transport roller 23B is not decentered, and the ejection timing of ink droplets is properly adjusted. Therefore, the first line and the second line formed with an adjustment amount of "0" match with respect to the transport direction.

Figure 7C:
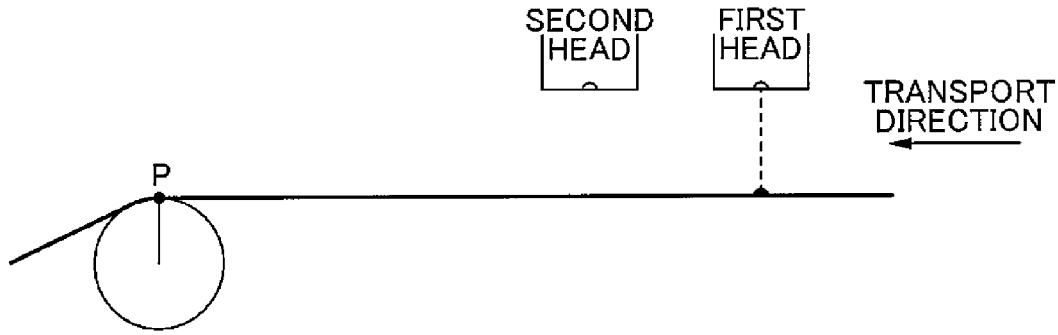
FIG. 7C is a diagram describing the state in which a first head forms a first line and then a second head forms a second line, when the transport roller 23B is decentered.
Figure 7D:
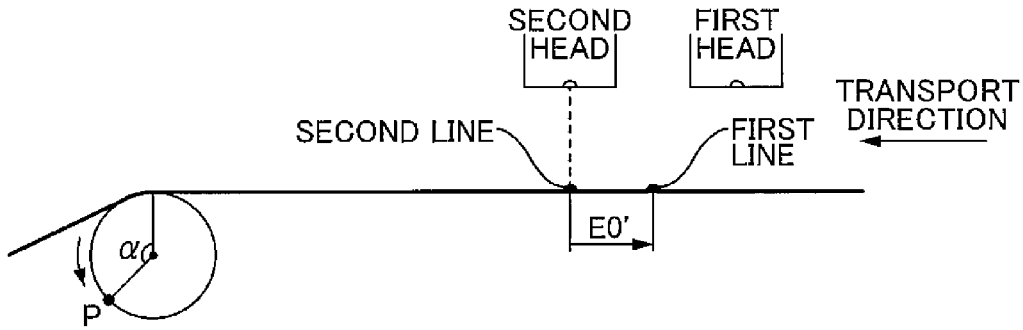
FIG. 7D is a diagram describing the state in which a first head forms a first line and then a second head forms a second line, when the transport roller 23B is decentered.

FIGS. 7C and 7D are diagrams describing a state in which the first head forms the first line and thereafter the second head forms the second line, when the transport roller 23B is decentered. In this case, the transport roller 23B is assumed to be decentered.

In FIG. 7C, ink droplets are ejected from the first head to form the first line. Then, paper is transported. At this time, the transport roller 23B is rotated by an angle α. Then, in FIG. 7D, the second line (formed with an adjustment amount of "0") is formed by the second head. However, a transport error E0' is produced due to decentering of the transport roller 23B, and thus the first line and the second line are formed shifted from each other with respect to the transport direction.

Referring again to FIGS. 7C and 7D, a reference point P is shown on the circumference of the transport roller 23B. The position on the circumference of the reference point P when the first head ejects ink droplets to form the first line is given as a rotational position X (rad) (X is a variable number). The position "0", which is the start point of the rotational position X, is set at the top of the circumference. The value of the variable number X increases as the transport roller 23B rotates leftward. A transport error E' produced during transport carried out after forming the first line when the reference point P is at a rotational position X and before subsequently forming the second line is defined as the transport error E' at the rotational position X.

For example, in order to simplify the description, it is assumed that the first line is formed when the rotational position X is "0" (FIG. 7C). Thereafter, a predetermined transport is carried out and the second line is formed (FIG. 7D). Then, the transport error E0' as shown in FIG. 7D is assumed to have been produced. At this time, the transport error at the rotational position X of the reference point P=0 is E0'.

Figure 7E:
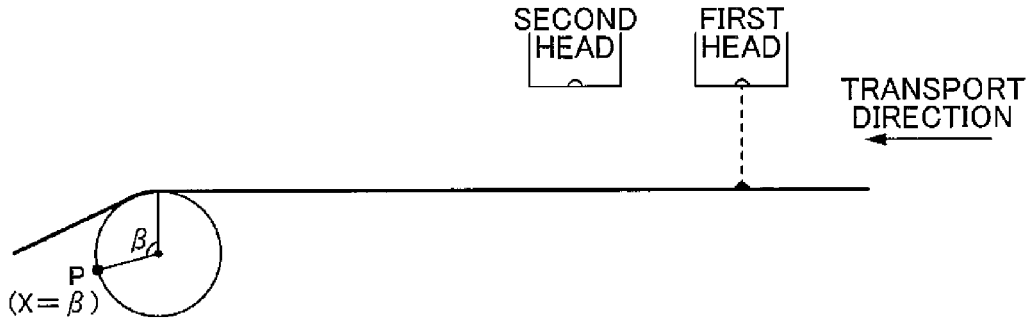
FIG. 7E is a diagram (of second example) describing the state in which a first head forms a first line and then a second head forms a second line, when the transport roller 23B is decentered.
Figure 7F:
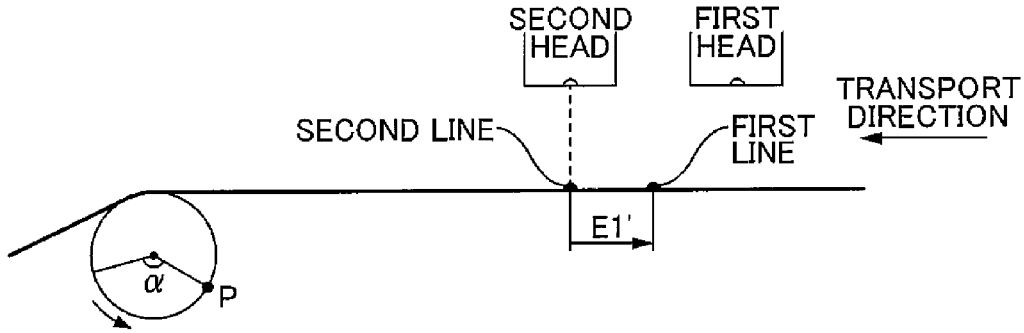
FIG. 7F is a diagram (of second example) describing the state in which a first head forms a first line and then a second head forms a second line, when the transport roller 23B is decentered.

FIGS. 7E and 7F are diagrams (of second example) describing a state in which the first head forms the first line and thereafter the second head forms the second line when the transport roller 23B is decentered. In FIG. 7E, the first line is assumed to have been formed when the rotational position X is at a certain rotational position β. Then, a predetermined transport is carried out and the second line is formed (FIG. 7F). Then, a transport error E1' as shown in FIG. 7E is assumed to have been produced. At this time, the transport error at the rotational position X of the reference point P=β is E1'. The transport error E' produced due to decentering can be expressed as a function of the rotational position X.

Figure 7G:
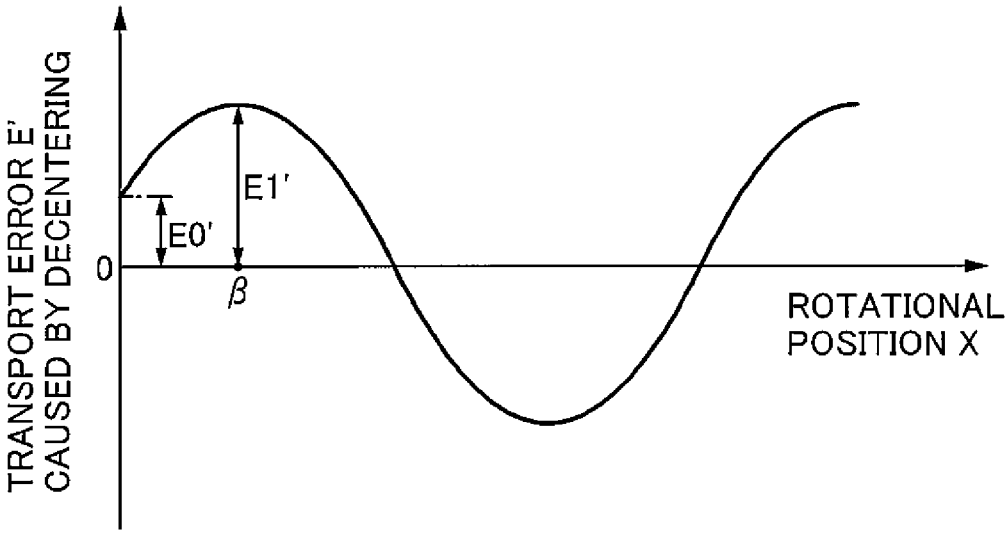
FIG. 7G is a graph showing the relation between a transport error produced due to decentering and a rotational position X.

FIG. 7G is a graph showing the relation between the transport error produced due to decentering and the rotational position X. The horizontal axis plots the rotational position X of the reference point P, while the vertical axis plots the transport error E' that is produced due to decentering of the transport roller 23B. As the rotational position X of the reference point P shifts (depending on the formation position on the medium of the first line), the transport error E' varies. Then, this transport error E' indicates values that form a sine curve as shown in FIG. 7G.

Regarding Actual Transport Error

Figure 8:
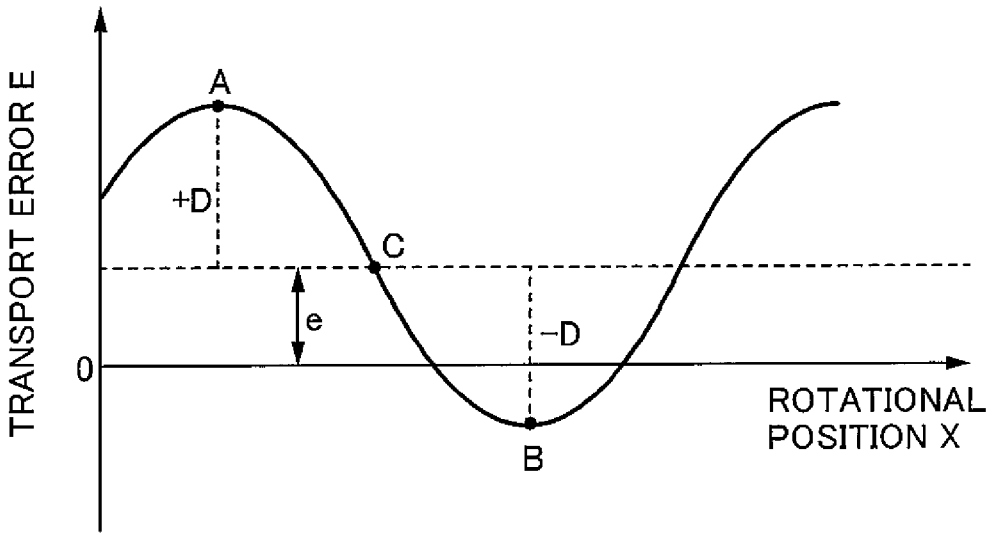
FIG. 8 is a graph describing the relation between the rotational position X of a reference point P and a transport error E.

FIG. 8 is a graph describing the relation between the rotational position X of the reference point P and the transport error E. The horizontal axis plots the rotational position X of the reference point P, while the vertical axis plots the transport error E. The actual transport error E is composed of a consistent component and a component that periodically varies, the components being combined. The periodic component appears with a full rotation of the transport roller 23B constituting one period. This periodic component corresponds to the transport error E' produced due to the above-described decentering of the transport roller 23B, which is referred to as an AC component of the transport error. On the other hand, the consistent component is produced due to errors in various sections of the printer 1 as described above, or due to incorrect ejection timing of ink droplets from the second head, even when the transport roller 23B is not decentered.

The AC component of the transport error E is caused by decentering of the transport roller 23B as described above, and forms a sine curve with a maximum amplitude of "D". The AC component of the transport error at the oscillation center thereof is "e". If the transport roller 23B is not decentered, and the transport error does not contain the AC component, the amount of the transport error to be produced will be "e". By adjusting the ejection timing of ink droplets from the second head such that the transport error "e" becomes "0" when the transport roller 23B is not decentered, it is possible to constantly match the first line and the second line formed with an adjustment amount of "0".

Even when the transport roller 23B is decentered and the transport error contains the AC component, it is preferable that the ejection timing of ink droplets from the second head is adjusted such that the transport error value "e" at the oscillation center (constant component value) becomes "0". The reason for this is described below.

Figure 9A:
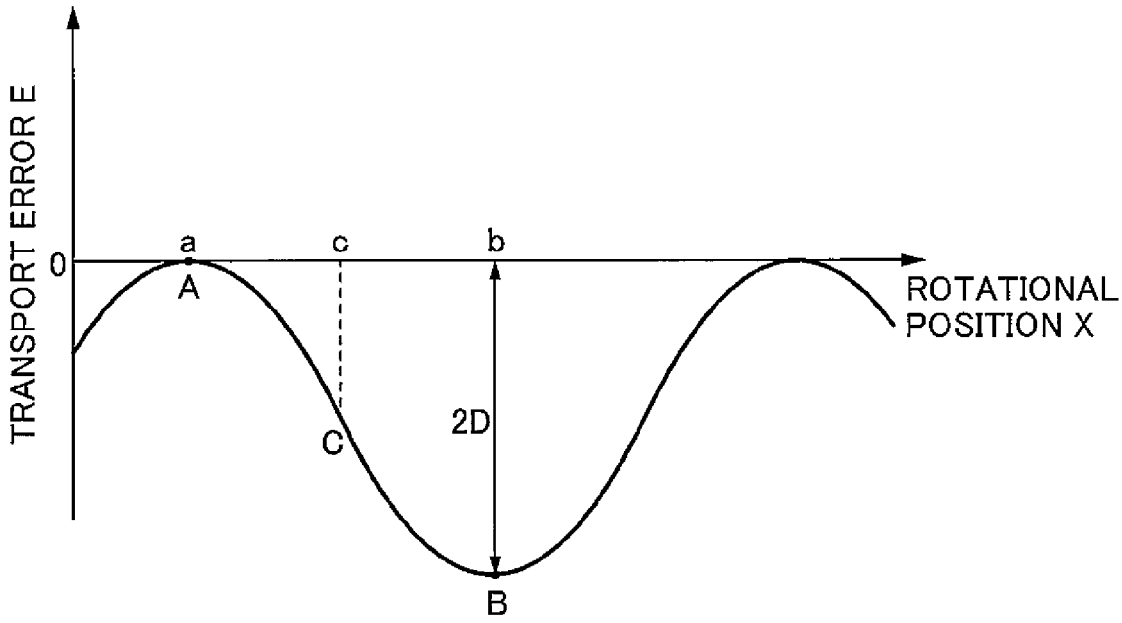
FIG. 9A is a graph showing the transport error when the ejection timing is adjusted such that the transport error at the point A in FIG. 8 becomes 0.

FIG. 9A is a graph showing the transport error when the ejection timing of ink droplets was adjusted such that the transport error at the point A in FIG. 8 becomes "0". In FIG. 9A, the transport errors at the rotational position X=a, b and c are shown. Referring to FIG. 9A, while the transport error is "0" at the rotational poison X=a, as the rotational position X is increased from X=a to X=b, the transport error is gradually produced. In particular, the transport error E at the rotational position X=b amounts to "2D".

Figure 9B:
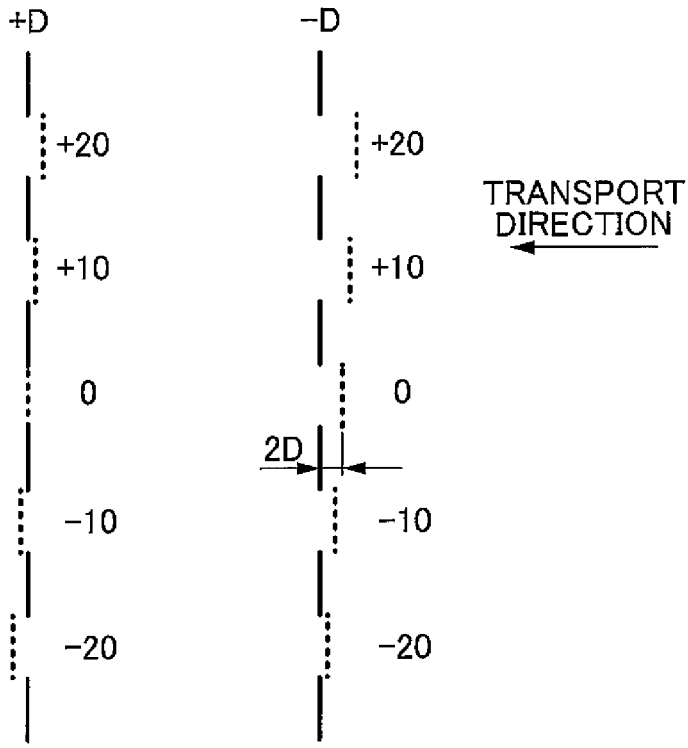
FIG. 9B shows an adjustment pattern when the ejection timing is adjusted such that the transport error at the point A in FIG. 8 becomes 0.

FIG. 9B shows an adjustment pattern when the ejection timing of the ink droplets is adjusted such that the transport error at the point A in FIG. 8 becomes "0". Two adjustment patterns shown in FIG. 9B are adjustment patterns formed after the ejection timing has been adjusted based on the adjustment pattern obtained at the rotational position X=a. That is, in these two adjustment patterns, adjustment is performed such that the first line and the second line formed with an adjustment amount of "0" match at the rotational position X=a.

The adjustment pattern on the left side of FIG. 9B is formed at the rotational position X=a. The adjustment pattern on the right side is formed at the rotational position X=b. Here, as a matter of course, the transport error in the adjustment pattern on the left side is "0" (the first line and the second line formed with a transport amount of "0" match). However, in the adjustment pattern on the right side a transport error is produced. The amount thereof is "2D".

Figure 10A:
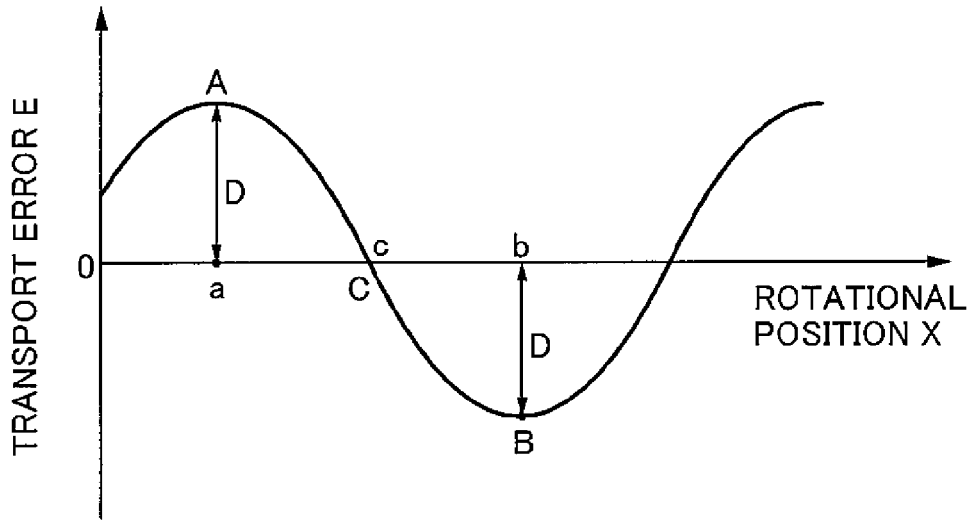
FIG. 10A is a graph showing the transport error when the ejection timing is adjusted such that the transport error at the point C in FIG. 8 becomes 0.

FIG. 10A is a graph showing the transport error when the ejection timing is adjusted such that the transport error at the point C in FIG. 8 becomes "0". In FIG. 10A, the transport errors at the rotational position X=a, b and c are shown. Referring to FIG. 10A, the transport error is "0"at the rotational poison X=c, and the transport error is "D" at the points A and B, where the maximum amplitude is produced.

Figure 10B:
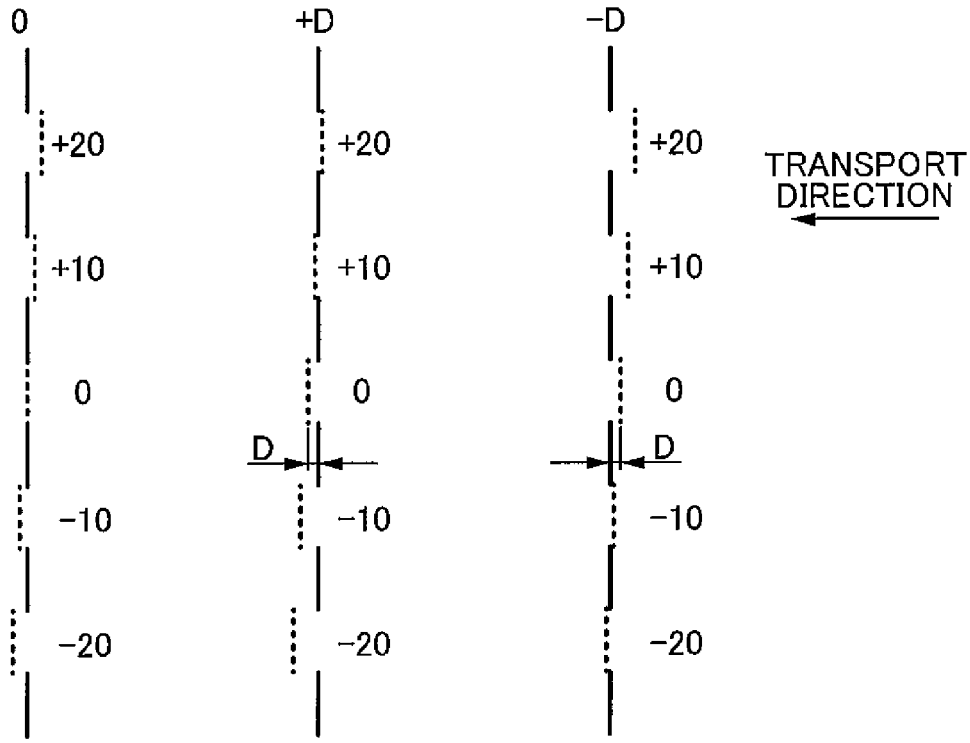
FIG. 10B shows an adjustment pattern when the ejection timing is adjusted such that the transport error at the point C in FIG. 8 becomes 0.

FIG. 10B shows an adjustment pattern when the ejection timing is adjusted such that the transport error at the point C in FIG. 8 becomes "0". Three adjustment patterns shown in FIG. 10B are adjustment patterns formed after the adjustment of the ejection timing has been adjusted based on the adjustment pattern obtained at the rotational position X=c. That is, in these three adjustment patterns, adjustment is performed such that the first line and the second line formed with an adjustment amount of "0" match at the rotational position X=c.

The adjustment pattern on the left side of FIG. 10B is formed at the rotational position X=c. The adjustment pattern at the center of FIG. 10B is formed at the rotational position X=a. The adjustment pattern on the right side of FIG. 10B is formed at the rotational position X=b. Here, as a matter of course, the transport error in the adjustment pattern on the left side is "0" (the first line and the second line formed with a transport amount of "0" match). However, in the other two adjustment patterns a transport error is produced. The amount thereof is "D" each.

When the ejection timing of ink droplets is adjusted such that the transport error at the point A or B becomes "0", the maximum shift amount between the first line and the second line becomes "2D". On the other hand, when the ejection timing of the ink droplets is adjusted such that the transport error at the point C becomes "0", the maximum shift amount between the first line and the second line becomes "D". Therefore, it is preferable that the ejection timing of the ink droplets is adjusted such that the transport error at the point C becomes "0" (the transport error at the oscillation center is "0") because of the smaller maximum shift amount.

If the point where the AC component of the transport error is "0" (the point C) can be determined during formation of the adjustment pattern, it is possible to adjust the ejection timing by forming the adjustment pattern at the point corresponding to the rotational position X=c. However, there is a problem that it is difficult to determine the point where the rotational position X=c during formation of the adjustment pattern. Therefore, in a first embodiment described next, a method is proposed by which the ejection timing of ink droplets can be adjusted such that the transport error becomes "0" at the oscillation center thereof, even when it is difficult to determine the point where the rotational position X=c.

First Embodiment

Description of Principle

Figure 11A:
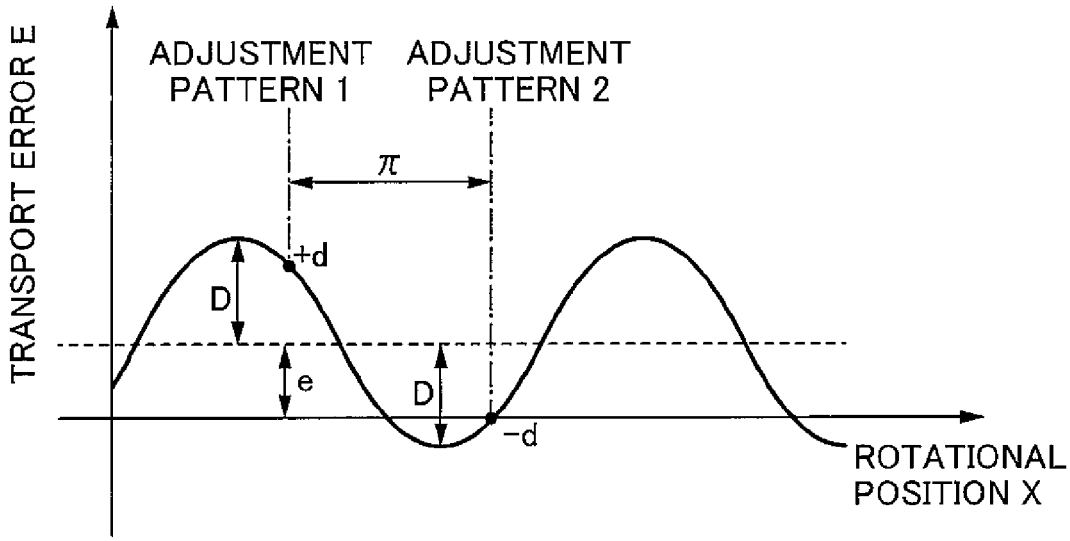
FIG. 11A is a diagram describing the relation between the rotational position of the transport roller 23B and the transport error.

FIG. 11A is a diagram describing the relation between the rotational position of the transport roller 23B and the transport error. The horizontal axis plots the rotational position X of the reference point P, while the vertical axis plots the transport error E at the rotational position X. In FIG. 11A, it is assumed the adjustment pattern 1 is recorded when the transport error is "+d" relative to the oscillation center "e". Then, it is assumed that the adjustment pattern 2 is recorded after the transport roller 23B has rotated by an amount of "π" from the point where the adjustment patter 1 was recorded. The transport error E forms a sine curve. Also, the period of the transport error is the same as the circumference length of the transport roller. Accordingly, the adjustment pattern 2 formed after the above rotation of the transport roller 23B by an amount of "π" is recorded when the transport error is "−d" relative to the oscillation center "e". That is, it is possible to obtain the value of the oscillation center "e" by averaging the transport errors obtained in the adjustment patterns 1 and 2. In other words, by obtaining an average of the transport errors obtained at positions whose rotational positions are separated by a distance "π", it is possible to offset the AC components of the transport error.

Figure 11B:
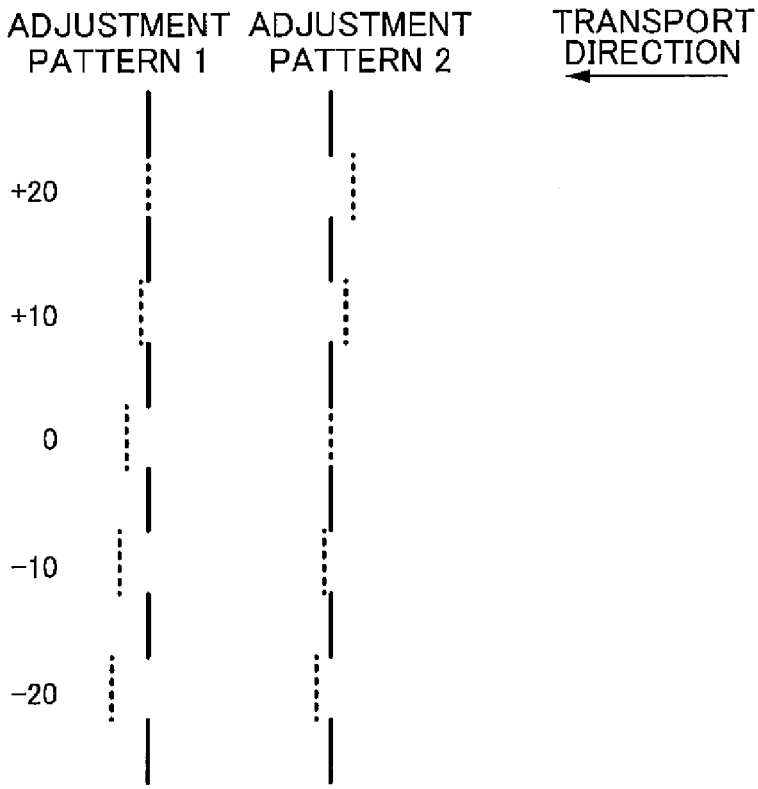
FIG. 11B is a diagram describing adjustment patterns that correspond to the patterns in FIG. 11A.

FIG. 11B is a diagram describing the adjustment patterns that correspond to the patterns in FIG. 11A. The adjustment pattern 1 is recorded when the transport error is "+d" relative to the oscillation center. The adjustment pattern 2 is recorded when the transport error is "−d" relative to the oscillation center. According to FIG. 11B, when the transport error is "+d" relative to the oscillation center, the first line and the second line formed with an adjustment amount of "+20" match. In addition, when the transport error is "−d" relative to the oscillation center, the first line and the second line formed with an adjustment amount of "0" match. In other words, because of the effect of the transport error due to decentering of the transport roller 23B, the adjustment amount with which the first line and the second line formed matched to each other differs between the adjustment pattern 1 and the adjustment pattern 2.

Figure 12:
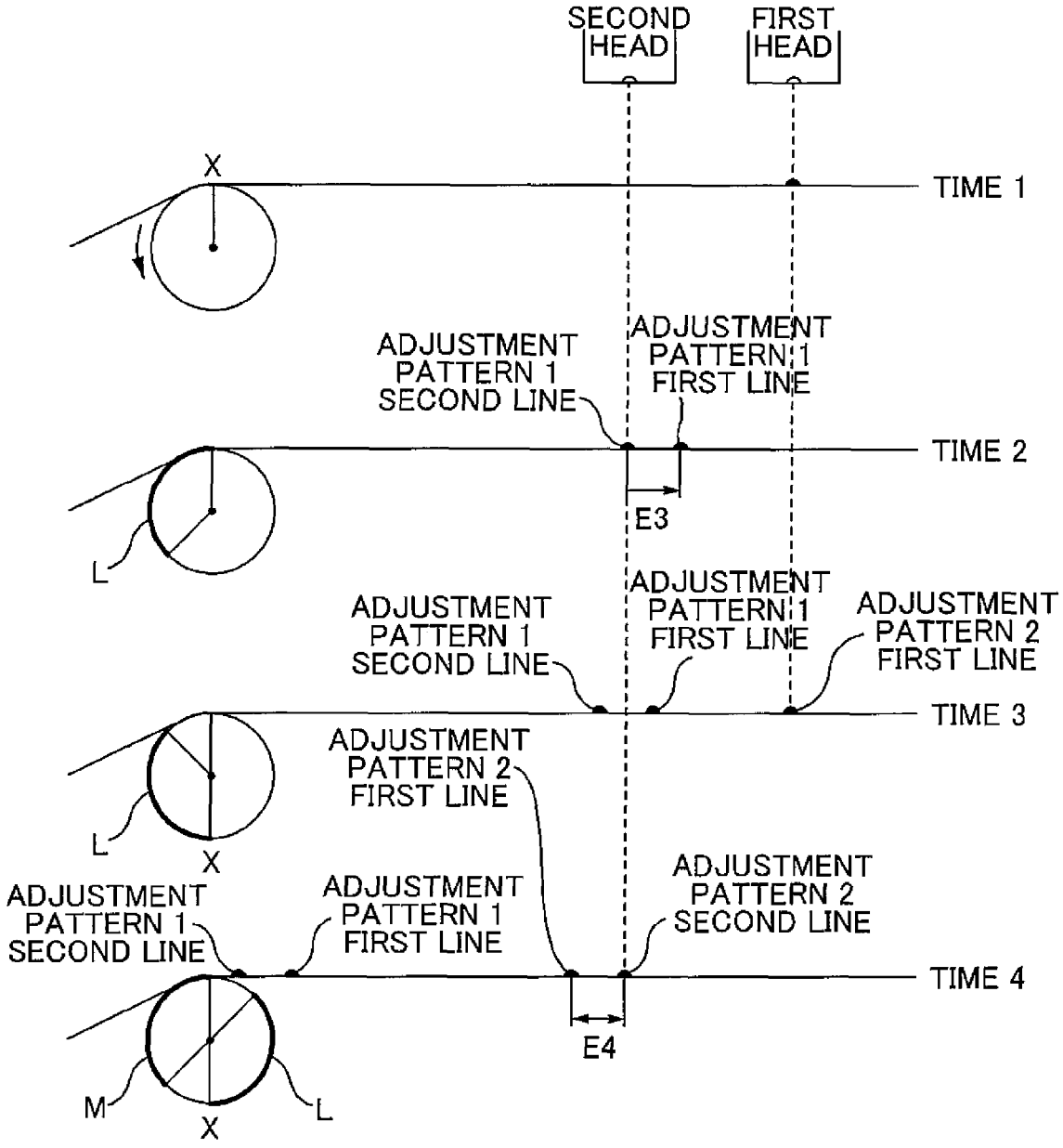
FIG. 12 is a diagram describing the transport error in an adjustment pattern 1 and an adjustment pattern 2.

FIG. 12 is a diagram describing the transport error in the adjustment pattern 1 and the adjustment pattern 2. FIG. 12 illustrates a state in which the paper S is transported in time series from a time 1 shown above to a time 4 and the adjustment pattern 1 and the adjustment pattern 2 are recorded. The time interval between the time 1 and the time 3 corresponds to a time during which the transport roller 23B performs a half rotation. Specifically, a time required for the transport roller 23B to rotate by an amount of "π". Here, the first line and the second line when an adjustment amount is "0" are taken as an example. Further, in this case the transport roller 23B is assumed to be decentered. In this example, the adjustment patterns are formed at rotational positions different from the rotational positions used when forming the adjustment patterns in FIGS. 11A and 11B.

At the time 1, ink droplets are ejected from the first head to record the first line of the adjustment pattern 1. Next, at the time 2, ink droplets are ejected from the second head to record the second line of the adjustment pattern 1. However, due to a transport error E3, the first line and the second line do not match with respect to the transport direction.

At the time 3, ink droplets are ejected from the first head to record the first line of the adjustment pattern 2. Next, at the time 4, ink droplets are ejected from the second head to record the second line of the adjustment pattern 2. However, due to a transport error E4, the first line and the second line do not match with respect to the transport direction.

A rotation angle γ of the transport roller 23B for the rotation after the first line of the adjustment pattern 1 has been formed and before forming the second line of the adjustment pattern 1 starts is the same as that for the rotation after the first line of the adjustment pattern 2 has been formed before forming the second line of the adjustment pattern 2 starts. As described above, the adjustment pattern 1 and the adjustment pattern 2 are formed separated from each other by a distance corresponding to a half rotation ("π").

From the time 1 to the time 2, a portion L on the circumference of the transport roller 233 contacts a paper in order to transport the paper. Therefore, the length of the circumference L corresponds to the transport amount during this transport. This transport amount contains the transport error E3. From the time 3 to the time 4, a portion M on the circumference of the transport roller 23B contacts a paper in order to transport the paper. Therefore, the length of the circumference M corresponds to the transport amount during this transport. This transport amount contains the transport error E4.

The transport errors at the rotational positions that are shifted from each other by a distance corresponding to a half period ("π") can offset the AC components contained in the respective transport errors by averaging the same. Therefore, by averaging the transport errors, it is possible to obtain the transport error when the transport roller 23B is not decentered. In other words, the average of the transport errors E3 and E4 represents a consistent transport error when the transport roller 23B is not decentered.

Incidentally, when the transport roller 23B is not decentered, the consistent transport error component can be removed by adjusting the ejection timing of ink droplets by a shift amount between the first line and the second line, so that the landing position of ink droplets from the first head and that of ink droplets from the second head can be aligned. However, even formation of the adjustment pattern is affected by the AC component of the transport error due to decentering of the transport roller 23B. Accordingly, the AC component of the transport error needs to be removed also when the ejection timing is adjusted.

With regard to this issue, as described above, the issue can be solved based on the principle that by averaging the respective transport errors at the rotational positions that are shifted from each other by an amount of "π", it is possible to obtain the transport error that offsets the AC components of the respective transport errors.

Again, FIGS. 11A and 11B are referred to. In the adjustment pattern 1, the first line and the second line match when the adjustment amount is "+20". At this time, a transport error of "+d" relative to the oscillation center "e" ("e+d" as an absolute value) is present during the formation of the adjustment pattern 1. On the other hand, in the adjustment pattern 2, the first line and the second line match when the adjustment amount is "0". At this time, a transport error of "−d" relative to the oscillation center "e" ("e−d" as an absolute value) is present during the formation of the adjustment pattern 2. Specifically, these adjustment amounts are amounts that contain the transport errors. These adjustment patterns are formed separated by a distance corresponding to a rotation for a distance "π". Therefore, by averaging these adjustment amounts, it is possible to offset the AC components in the transport errors contained in the adjustment amounts. That is, by averaging these adjustment amounts, it is possible to obtain the adjustment amount from which the AC component in the transport error is removed.

Specifically, the adjustment amount indicating the ejection timing judged suitable in the adjustment pattern 1 and that indicating the ejection timing judged suitable in the adjustment pattern 2 are averaged. Then, the average value thus obtained shall be the adjusted ejection timing. The adjustment amount corresponds to a consistent component "e" in the transport error described above. This obtained average value is set again in the printer 1 as the adjusted ejection timing, and thereby the ejection timing can be adjusted such that the maximum shift amount between the first line and the second line becomes the smallest.

In the adjustment pattern 1, the first line and the second line match with an adjustment amount of "+20". In the adjustment pattern 2, the first line and the second line match with an adjustment amount of "0". Accordingly, the average adjustment value is "+10". Then, by readjusting the ejection timing such that ink droplets ejected from the second head land on the further upstream side by 10 μm, appropriate ejection timing can be achieved.

Figure 13:
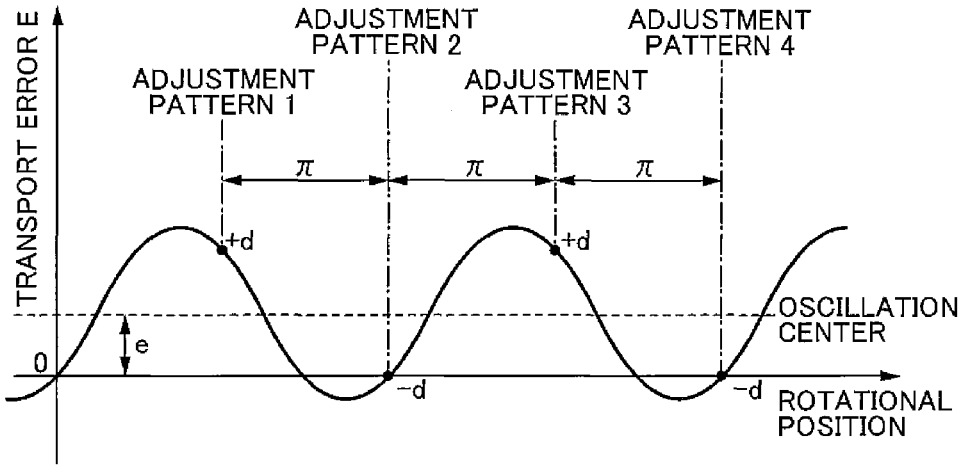
FIG. 13 is a diagram describing the case in which four adjustment patterns are used to adjust the ejection timing.

FIG. 13 is a diagram describing the case in which four adjustment patterns are used to adjust the ejection timing. The principle is the same as that described above, and it is possible by averaging adjustment amounts to obtain the adjustment amount of the ejection timing by which the transport error becomes "0" at the oscillation center thereof. In such a case, the number of samples used in obtaining the average value is large, so more precise adjustment amount of the ejection timing can be obtained.

When the adjustment pattern is not formed at every rotational angle of "π" of the transport roller 23B, by obtaining the above-described average of the adjustment amounts, it is at least possible, by obtaining the average of adjustment amounts as described above, to obtain the adjustment amount of the ejection timing by which the transport error becomes "0" at a point close to the oscillation center thereof. Therefore, even if the adjustment pattern is not formed at every rotational angle of "π" of the transport roller 23B, it is possible to obtain a favorable adjustment amount of the ejection timing.

In the first embodiment, the ejection timing is adjusted by using a plurality of adjustment patterns based on the above principle.

Procedure of the Method for Adjusting Ejection Timing

Figure 14:
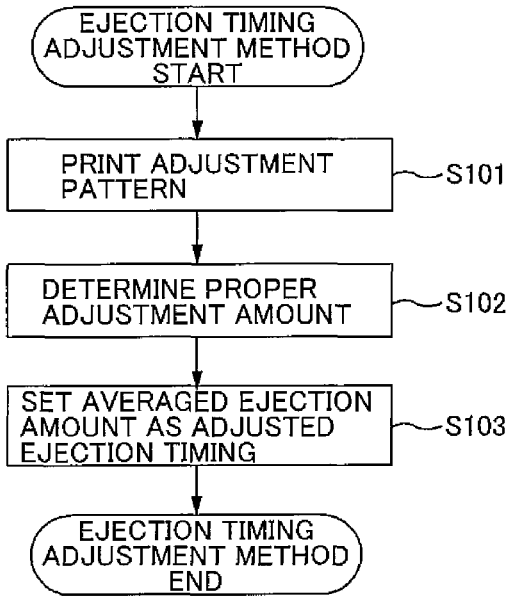
FIG. 14 is a flowchart describing a method for adjusting the ejection timing of ink droplets.

FIG. 14 is a flowchart describing a method for adjusting the ejection timing of ink droplets. Adjustment of the ejection timing of ink droplets is carried out during the manufacturing process of the printer.

Firstly, four adjustment patterns 1 to 4 are formed at every rotational angle of "π" of the transport roller 23B on a paper (S101).

Figure 15:
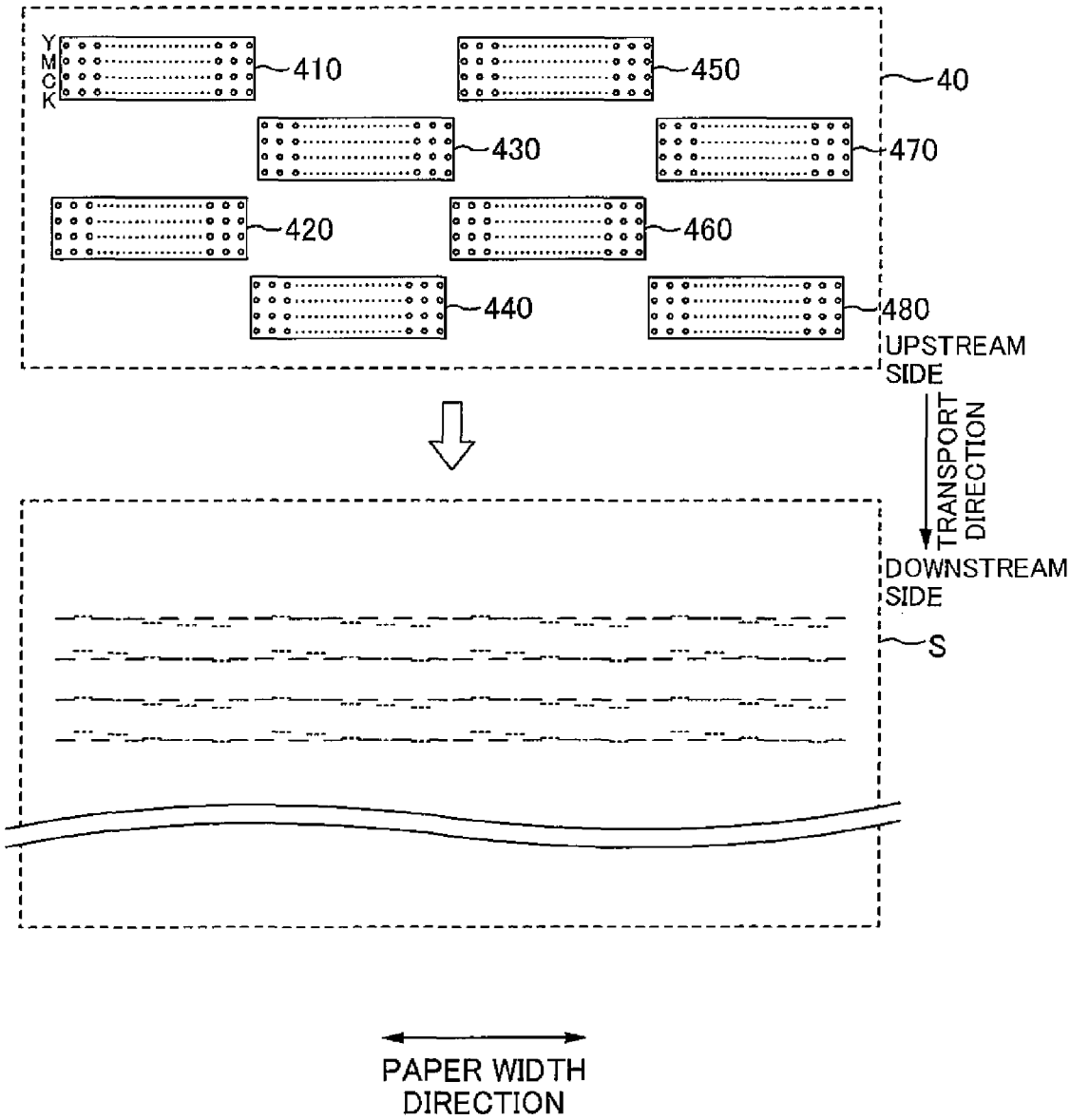
FIG. 15 is a diagram describing a plurality of adjustment patterns formed in the first embodiment and a head unit 40.

FIG. 15 is a diagram describing a plurality of adjustment patterns formed in the first embodiment and the head unit 40. FIG. 15 shows the head unit 40 and a paper S that has been transported. The configuration of the head unit 40 is the same as that described before. On the paper S, four adjustment patterns described above are formed in the paper transport direction. Specifically, four adjustment patterns are formed with the first head 410 and the second head 420. Similarly, four adjustment patterns are formed with the third head 430 and the fourth head 440, and four adjustment patterns are formed with the fifth head 450 and the sixth head 460. Further, four adjustment patterns are formed with the seventh head 470 and the eighth head 480. Each adjustment pattern is formed with the black nozzle row K of four nozzle rows.

Figure 16:
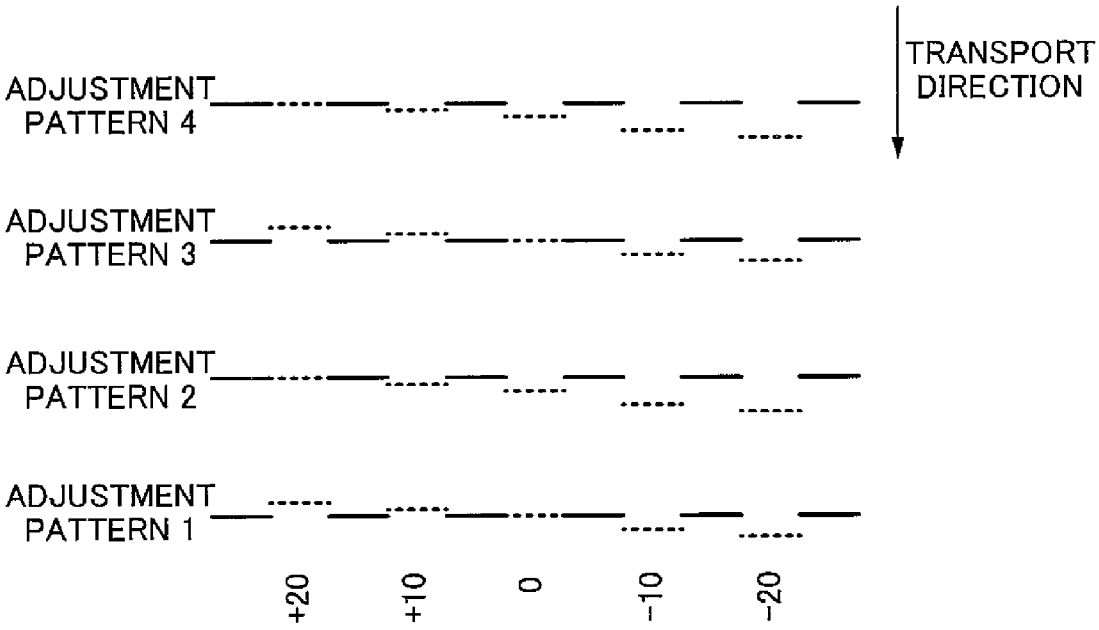
FIG. 16 is a diagram describing four adjustment patterns.

FIG. 16 is a diagram describing four adjustment patterns. FIG. 16 shows four adjustment patterns formed on the paper S with the first head 410 and the second head 420. Also in FIG. 16, the paper transport direction is from the above to the bottom of the drawing. And these four adjustment patterns are sequentially referred to, from the adjustment pattern at the bottom to the adjustment pattern at the top, as an adjustment pattern 1 to an adjustment pattern 4.

After these adjustment patterns have been formed, the first line and the second line that match the most with respect to the transport direction are determined for each adjustment pattern, and the corresponding adjustment amounts are determined (S102). For example, in the adjustment pattern 1, the first line and the second line match the most with respect to the transport direction when the adjustment amount is "0". Therefore, it is determined for the first adjustment pattern 1 that the ejection timing with an adjustment amount of "0" is the best ejection timing with respect to the transport direction. In a similar manner, determination is made for the adjustment patterns 2 to 4. According to FIG. 16, the adjustment amount is determined as "+20", "0" and "+20" respectively for the adjustment patterns 2 to 4.

After the adjustment amounts of the ejection timing have been determined as above, an average value of the adjustment amounts is obtained (S103). In FIG. 16, favorable adjustment amounts of ejection timings are "0" for the adjustment pattern 1, "+20" for the adjustment pattern 2, "0" for the adjustment pattern 3, and "+20" for the adjustment pattern 4. The average value of these amounts is "+10". That is, the adjustment amount of the ejection timing that minimizes the variance in the landing positions for this printer is "+10".

Once the adjustment amount of the ejection timing is obtained, the ejection timing of ink droplets are adjusted such that the ejection timing is shifted by the amount corresponding to the obtained adjustment value. This adjustment can be performed by changing the ejection timing by the amount corresponding to the adjustment value via a user interface of the printer 1. Also, the adjustment amount may be sent to the printer 1 via the computer 110 connected to the printer 1.

The average adjustment amount of the printer described here was "+10". Accordingly, by readjusting the ejection timing to a delayed timing such that the ink droplets ejected from the second head 420 land at the position shifted by 10 μm to the further upstream side, proper ejection timing can be achieved.

In this description, a method for adjusting the ejection timing is described taking a pair of the first head and the second head as an example. In a similar manner, such adjustment can be performed for a pair of the third head and the fourth head, a pair of the fifth head and the sixth head, and a pair of the seventh head and the eighth head. Also, it is possible to adjust ejection timing for each color in a similar manner.

In addition, although the fluctuation in the transport amount was described taking decentering of the transport roller 23B as an example, the ejection timing can be adjusted based on the same principle also in the case in which a gear or a transport motor for driving the transport roller 23B is decentered. That is, a gear or a transport motor may be used as a rotational member to transport paper.

Other Configurations of Nozzles

A case is also possible in which the user desires to perform printing at a resolution increased with respect to the paper width direction. Next, a configuration of the head is described for performing printing at a resolution increased with respect to the paper width direction.

Figure 17:
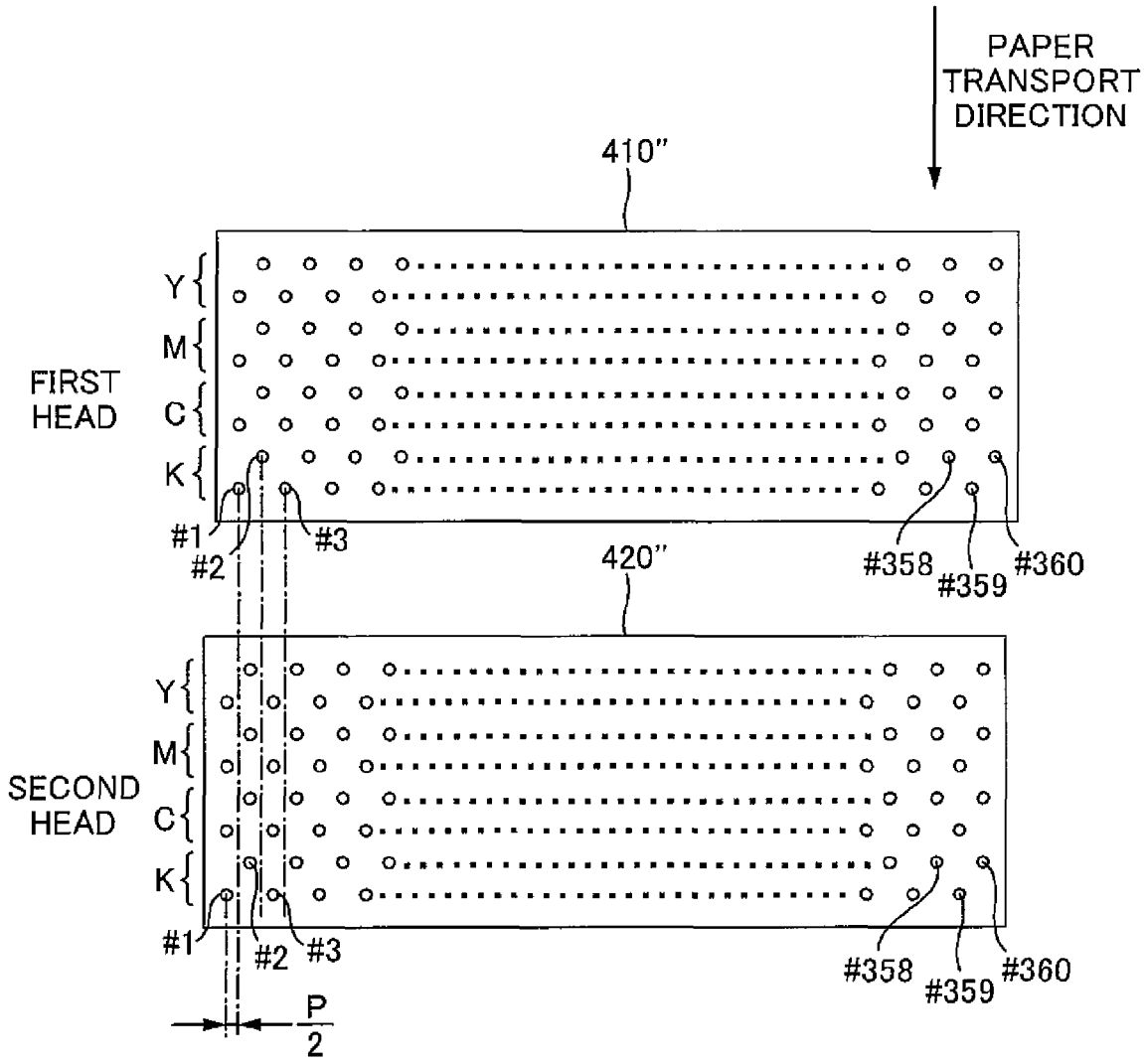
FIG. 17 is a diagram describing a variation of the configuration of the head of the first embodiment.

FIG. 17 is a diagram describing a variation of the configuration of the head of the first embodiment. FIG. 17 shows a first head 410" and a second head 420" as a variation of the first head 410 and the second head 420. The variation provides a head configuration for performing printing at a resolution increased with respect to the paper width direction.

The first head 410" includes two nozzle rows for each color, namely, eight nozzle rows in total. In this description black ink nozzles K is used as an example. The black ink nozzles K are made up of two nozzle rows, that is, an odd-numbered nozzle row and an even-numbered nozzle row. The odd-numbered nozzle row and the even-numbered nozzle row are disposed shifted from each other with respect to the transport direction. Each even-numbered nozzle is disposed so as to be placed at the center of two odd-numbered nozzles. For example, the nozzle #2 is disposed so as to be positioned between the nozzle #1 and the nozzle #3. Through this, the dot pitch that can be realized by the first head 410" alone is 360 dpi. Specifically, as shown in FIG. 17, the nozzle pitch P realized by the nozzle #1 and the nozzle #2 is 360 dpi.

The second head 420" has the same head configuration as the first head 410". The second head 420" is disposed shifted from the first head 410" by an amount corresponding to P/2 in a direction intersecting the transport direction. In other words, the nozzle #1 of the first head 410" is disposed so as to be positioned between the nozzle #1 and the nozzle #2 of the second head 420". Through this, the dot pitch that can be realized by the first head 410" and the second head 420" is 720 dpi.

It should be noted that although the odd-numbered nozzle row and the even-numbered nozzle row of the first head 410" are disposed shifted from each other with respect to the paper transport direction, the ejection timing of ink droplets onto the paper is adjusted such that the landing positions thereof match with respect to the paper transport direction.

Also, although the first head 410" and the second head 420" are taken as an example in this description, this configuration is applicable for a pair of a third head 430" and a fourth head 440", a pair of a fifth head 450" and a sixth head 460", and a pair of a seventh head 470" and an eighth head 480". The nozzle heads are disposed such that the nozzle #1 of the third head 430" and the nozzle #360 of the first head 410" have the nozzle pitch of P/2. The nozzle heads are disposed such that the nozzle #1 of the fourth head 440" and the nozzle #360 of the second head 420" have the nozzle pitch of P/2. The nozzle heads are disposed such that the nozzle #1 of the fifth head 450" and the nozzle #360 of the third head 430" have the nozzle pitch of P/2. The nozzle heads are disposed such that the nozzle #1 of the sixth head 460" and the nozzle #360 of the fourth head 440" have the nozzle pitch of P/2. The nozzle heads are disposed such that the nozzle #1 of the seventh head 470" and the nozzle #360 of the fifth head 450" have a nozzle pitch of P/2. The nozzle heads are disposed such that the nozzle #1 of the eighth head 480" and the nozzle #360 of the sixth head 460" have a nozzle pitch of P/2.

Through this, it is possible to perform printing at 720 dpi with respect to the paper transport direction. At such time as well, the ejection timing of ink droplets from the first head and the second head needs to be adjusted. In such a case as well, the ejection timing can be adjusted in the same manner as the first embodiment.

Second Embodiment

Overall Configuration

Figure 18:
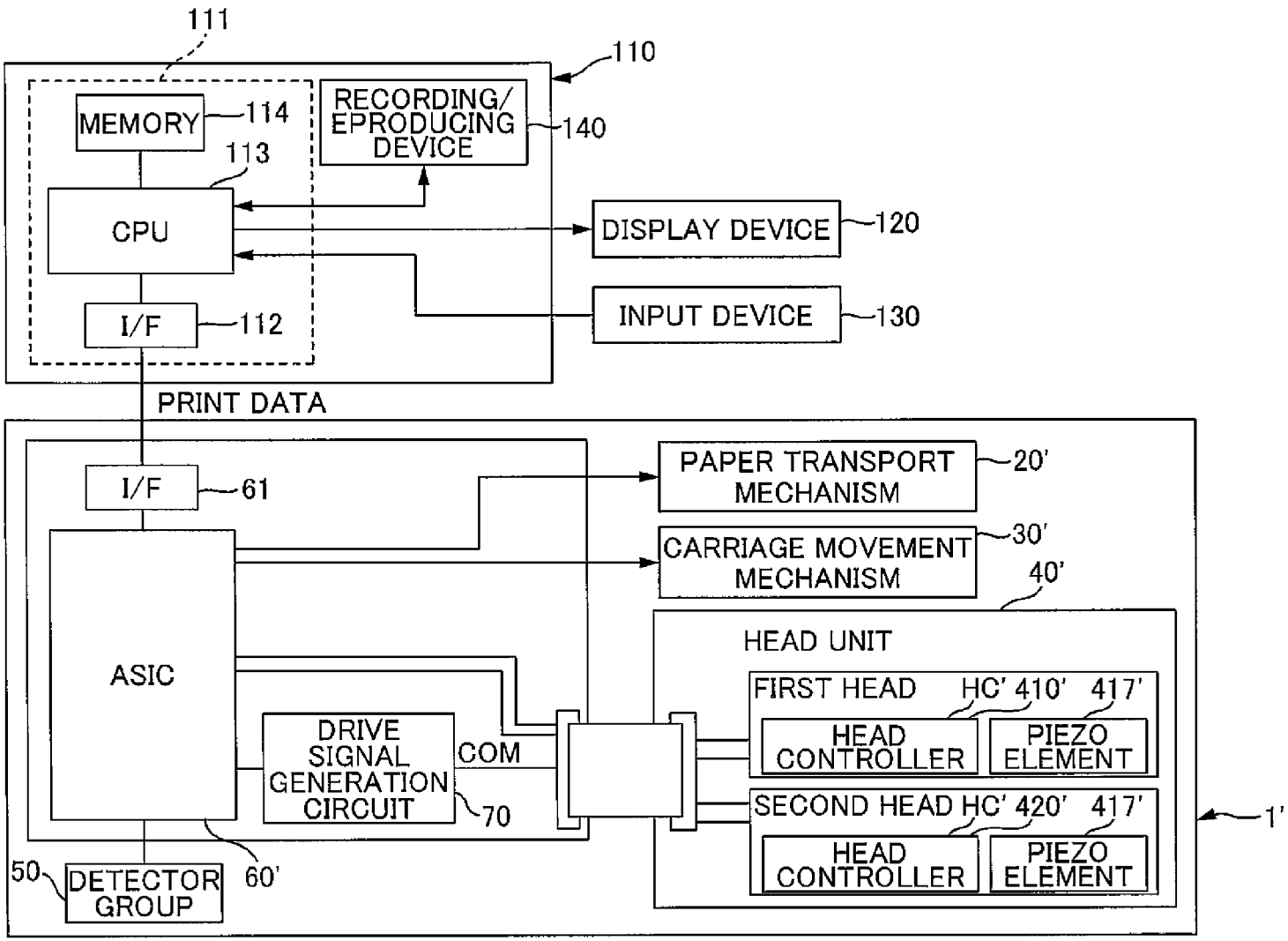
FIG. 18 is a block diagram of a printing system according to a second embodiment.

FIG. 18 is a block diagram of a printing system according to a second embodiment. A printing system 100' is provided with a printer 1', a computer 110, a display device 120, and an input device 130. In the second embodiment, the printer 1' is an inkjet printer that prints an image on a medium such as paper, cloth, or film.

Since the computer 110, the display device 120, and the input device 130 are the same as in the first embodiment, description thereof is omitted. Next, description is given concerning a configuration of the printer 1' in the second embodiment.

Figure 19A:
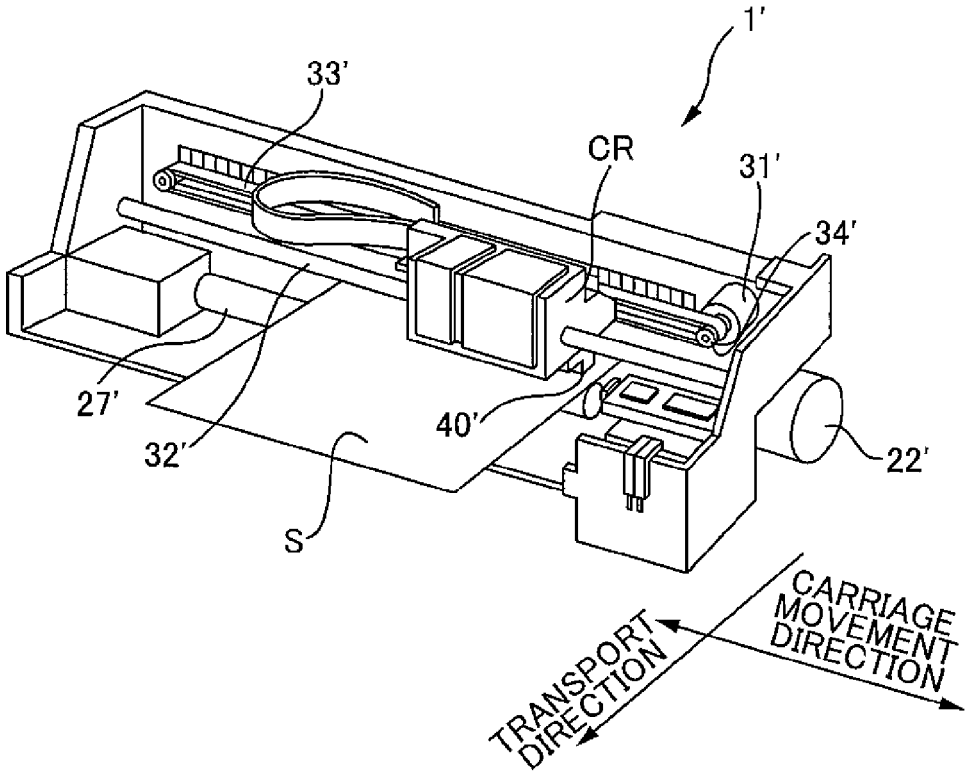
FIG. 19A is a perspective view of a printer 1' according to the second embodiment.
Figure 19B:
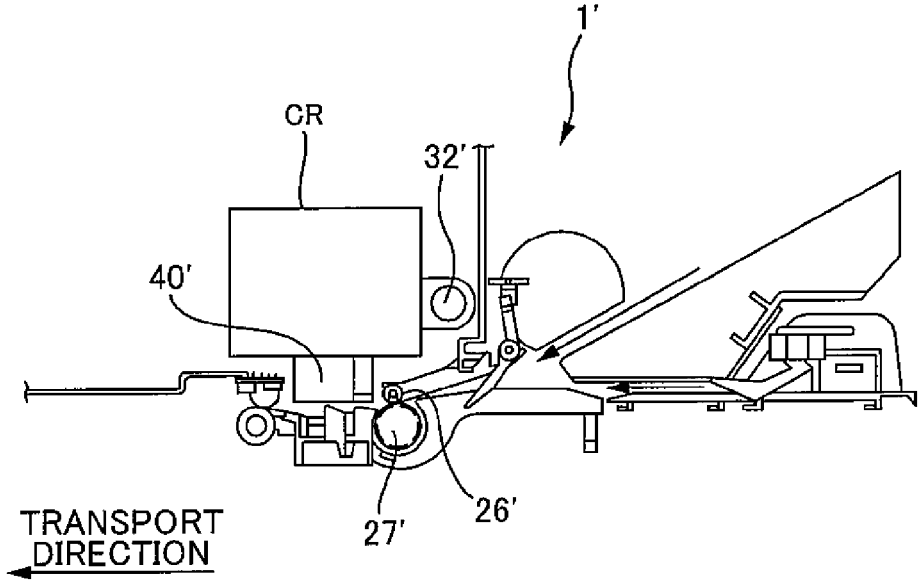
FIG. 19B is a cross-sectional view of the printer 1' according to the second embodiment.

FIG. 19A is a perspective view of a printer 1' according to the second embodiment, and FIG. 19B is a cross-sectional view of the printer 1' according to the second embodiment. The basic configuration of an inkjet printer, which is a printer according to the second embodiment, is described below with reference to FIG. 18 as well.

The printer 1' of the second embodiment includes a paper transport mechanism 20', a carriage movement mechanism 30, a head unit 40', a detector group 50, an ASIC 60', and a drive signal generation circuit 70.

The paper transport mechanism 20' feeds the paper S serving as a medium up to a printable position, and transports the paper S by a predetermined transport amount in the transport direction. Then, as shown in FIGS. 19A and 19B, the paper transport mechanism 20' includes a transport motor 22' and a transport roller 27'. The transport motor 22' is a motor for transporting the paper S in the transport direction, and its operation is controlled by the ASIC 60'. The transport roller 27' is a roller for transporting the paper S to a printable region with the paper S being sandwiched between it and a driven roller 26'. Although the paper transport mechanism 20 according to the first embodiment transports a single sheet of paper successively, the paper transport mechanism 20' according to the second embodiment transports the paper S intermittently.

The carriage movement mechanism 30' is for moving the carriage CR, to which the head unit 40' is attached, in a movement direction of the carriage CR. The carriage movement mechanism 30' includes a carriage motor 31', a guide shaft 32', a timing belt 33', and a drive pulley 34'. The movement of the carriage CR in the movement direction is controlled as a result of the carriage motor 31' being controlled by the ASIC 60'. When the carriage motor 31' is driven, the carriage CR moves along the guide shaft 32'. Along with this, the head unit 40' also moves in the carriage movement direction.

The head unit 40' is for ejecting ink droplets onto the paper S. The head unit 40' includes a first head 410' and a second head 420'. The first head 410' and the second head 420' are for forming dots by ejecting ink droplets on the paper S.

The first head 410' and the second head 420' each have four nozzle rows, and each nozzle row includes a plurality of nozzles (180 nozzles each in the second embodiment). The first head 410' and the second head 420' are provided in a carriage CR, and therefore when the carriage CR moves, the first head 410' and the second head 420' also move in the same direction. Then, dot rows are formed on the paper S along the movement direction as a result of the first head 410' and the second head 420' intermittently ejecting ink while moving.

The detector group 50 includes a linear encoder, and the position of the carriage CR is detected by the ASIC 60'. Then, movement of the carriage CR by a predetermined amount can be controlled by the ASIC 60'.

The drive signal generation circuit 70 has the same configuration as that already described, and therefore description thereof is omitted.

FIG. 20 is a diagram describing the relation of the first head 410', the second head 420' and a plurality of adjustment patterns printed on paper according to the second embodiment.

The head unit 40' is configured so as to be included in the carriage CR. And the head unit 40' includes the first head 410' and the second head 420'. Each head includes four nozzle rows. Each nozzle row of the respective heads includes 180 nozzles and piezo elements 417 for causing ink droplets to be ejected from the nozzles. The piezo elements 417 are attached independently one for one to the nozzles. Furthermore, the driving pulses to be applied to the piezo elements 417 of the nozzles are selected under the control of the head controller HC'. Ink droplets are ejected from the individual nozzles due to the application of the driving pulses to the piezo elements 417.

In FIG. 20, the first head 410' and the second head 420' are shown as seen from above the printer 1'. When viewed from above the printer 1', these nozzles are hidden by other components and cannot be seen. However, here the positions of the nozzles are drawn with solid lines to facilitate understanding of a relation between the nozzles of the first head 410' and the nozzles of the second head 420'.

These heads are disposed such that the nozzle row direction of the heads matches the paper transport direction. The first head 410' and the second head 420' each include four nozzle rows so as to be capable of ejecting four colors of ink droplets. Each nozzle row includes 180 nozzles, from nozzle #1 to nozzle #180. The distance between nozzles in each nozzle row (nozzle pitch P) is 1/180 inch.

The second head 420' is configured so as to be shifted to the upstream side by an amount corresponding to a half the nozzle pitch (P/2) in the paper transport direction with respect to the first head 410'. Therefore, the nozzle #1 of the first head 410' is disposed so as to be positioned between the nozzle #1 and the nozzle #2 of the second head 420'. In this manner, a resolution of 360 dpi is realized in the paper transport direction with the first head 410' and the second head 420'. At such time as well, the ejection timing of ink droplets from the first head 410' and the second head 420' needs to be adjusted. Such adjustment is necessary because a rotating member for shifting the relative position of the paper and the head may be decentered, as described above. Here, the drive pulley 34 for moving the carriage CR corresponds to the rotating member for shifting the relative position of the paper and the head.

As a conclusion, similarly to the first embodiment, by forming the adjustment patterns 1 to 4, determining suitable adjustment amounts for the ejection timings thereof, employing the average of the determined adjustment amounts as the adjusted ejection timing, more suitable ejection timing can be set.

Other Embodiments

The above described technique can be applied to various industrial apparatuses, in addition to a printing method that involves ejecting ink onto paper or the like to perform printing. Typical examples of this include printing apparatuses (methods) for printing patterns on cloths, circuit board manufacturing apparatuses (methods) for forming circuit patterns on circuit boards, DNA chip manufacturing apparatuses (methods) for manufacturing DNA chips by applying a solution in which DNA is dissolved to a chip, and manufacturing apparatuses (methods) for displays such as organic EL displays.

The foregoing embodiment is merely for facilitating the understanding of the invention, but is not meant to be interpreted in a manner limiting the scope of the invention. The invention can of course be altered and improved without departing from the gist thereof and includes functional equivalents. In particular, the embodiments mentioned below are also included in the scope of invention.

Regarding the Heads

In the foregoing embodiment, ink was ejected using piezoelectric elements. However, the method for ejecting liquid is not limited to this. Other methods, such as a method for generating bubbles in the nozzles through heat, may also be employed.

Also, in the foregoing embodiments, the head is provided in the carriage. However, it is also possible to provide the head in an ink cartridge that can be attached and detached to and from the carriage.

CONCLUSION (1) In the foregoing embodiments, a step is carried out that involves forming adjustment patterns on the paper S by changing the ejection timings of ink droplets from the nozzle rows of the first head 410 and the second head 420 lined up in the direction intersecting a row direction in which nozzles of the nozzle rows of the first head 410 and the second head 420 are lined up, while shifting the relative position of the nozzle row of the first head 410 (black nozzle row for example) and the nozzle row of the second head 420 (black nozzle row for example), and the paper S in the direction intersecting the nozzle rows. Changing the ejection timing of ink droplets corresponds to shifting the landing position of ink droplets.

Next, a step of determining the adjustment amount of the ejection timing of the nozzle rows of the first head 410 and the second head 420 based on the adjustment pattern is carried out.

Then, in the above operation, a plurality of adjustment patterns are formed separated from each other by a predetermined distance in the direction intersecting the nozzle rows. Also, the ejection timing is adjusted based on the average of the adjustment amounts determined based on the respective adjustment patterns.

Through this, the ejection timing of ink droplets ejected from a plurality of heads can be properly adjusted.

(2) The above-described predetermined distance is the circumferential length of the rotating member for shifting the relative position when rotated a half rotation.

Through this, the most suitable ejection timing can be achieved by adjustment.

(3) The number of the adjustment patterns formed is any even number, and the ejection timing is adjusted based on the average of the adjustment amounts determined based on these adjustment patterns in an even number.

By forming the adjustment patterns in an even number, and adjusting the ejection timing based on the average of adjustment amounts in an even number in this manner, it is possible to offset the transport error caused by decentering of the transport roller 23B.

(4) In addition, the above-mentioned rotating member is the transport roller 23B for transporting the paper S in a direction intersecting the nozzle row, and the above-mentioned relative position can be shifted by rotating the transport roller 23B and transporting the paper S.

Through this, even in a configuration such as that of a line printer, the ejection timing of ink droplets ejected from a plurality of heads can be properly adjusted.

(5) In addition, the above-mentioned rotating member is the drive pulley 34' that moves the nozzle rows of the first head 410' and the second head 420' in a direction intersecting the nozzle rows, and the above-mentioned relative position can be shifted by rotating the drive pulley 34' and moving the nozzle rows of the first head 410' and the second head 420'.

Through this, even in a configuration such as that of an inkjet printer in which a carriage moves, the ejection timing of ink droplets ejected from a plurality of heads can be properly adjusted.

(6) Furthermore, with respect to the nozzle row direction of the first head 410, each nozzle of the nozzle row of the first head 410 is disposed so as to be positioned at the center of two nozzles of the nozzle row of the second head 420.

Through this, it is possible to double the resolution in the nozzle row direction.

(7) The adjustment pattern is formed as follows; the landing position of ink droplets from the nozzle row of the second head 420 is shifted in a direction intersecting the nozzle row, with respect to the landing position of ink droplets from the nozzle row of the first head 410, as a result of the ejection timing of ink droplets from the nozzle row of the second head 420 being shifted for each nozzle.

Through this, the landing position of ink droplets from the second head 420 is gradually shifted with respect to the landing position of ink droplets from the first head 410, so that the suitable ejection timing can be selected based on the landing position of ink droplets ejected at the shifted ejection timing.

(8) Also, the adjustment pattern is formed as follows; ink droplets ejected from a predetermined number of nozzles of the nozzle row of the first head 410 and those ejected from a predetermined number of nozzles of the nozzle row of the second head 420 land alternately with respect to the nozzle row direction of the first head 410.

Through this, ink droplets ejected from the first head and those from the second head respectively land on the paper S in a width corresponding to the predetermined number of nozzles. Therefore, the ejection timing can be determined based on the shift amount with respect to the transport direction.

(9) Furthermore, it is apparent that an ejection timing adjusting apparatus described below is possible. The ejection timing adjusting apparatus includes a recording device and an input device (such as a keyboard of the computer 110). The recording device forms an adjustment pattern on the paper S by changing the ejection timing of ink droplets from the nozzle rows of the first head 410 and the second head 420 lined up in a direction intersecting a row direction in which nozzles of the nozzle rows of the first head 410 and the second head 420 are lined up, while shifting the relative position of the nozzle rows of the first head 410 and the second head 420, and the paper S in the intersecting direction. The input device inputs the adjustment amount of the ejection timing of the nozzle rows of the first head 410 and those of the second head 420 based on the adjustment pattern.

A plurality of adjustment patterns are formed separated from each other by a predetermined distance in a direction intersecting the nozzle rows. Then, the ejection timing adjusting apparatus further includes an arithmetic processing section for obtaining the ejection timing based on the average of the adjustment amounts inputted based on the respective adjustment patterns.

Through this, the ejection timing of ink droplets ejected from the plurality of heads can be properly adjusted.

(10) It is apparent that a program is possible for causing a computer to execute the above methods, which thereby realizes the above-described ejection timing adjusting apparatus.

What is claimed is:

1. A method for adjusting ejection timing comprising:

forming an adjustment pattern including a plurality of first patterns and a plurality of second patterns on a medium by changing a relative position between first and second nozzle rows and the medium in an intersecting direction that intersects a row direction in which nozzles of the first nozzle row and the second nozzle row are lined up and gradually changing an ejection interval between formation of the first patterns by electing liquid droplets from the first nozzle row and formation of the second patterns by ejecting liquid droplets from the second nozzle row, the first nozzle row and the second nozzle row being arranged parallel to each other and being separated from each other in the intersecting direction; and determining an adjustment amount of ejection timing of the first nozzle row and the second nozzle row based on the adjustment pattern, wherein, with the gradually changing election interval being maintained, a plurality of the adjustment patterns are formed with a separation of a predetermined distance in the intersecting direction between each other, and the ejection timing is adjusted based on an average of adjustment amounts determined based on the adjustment patterns.

2. A method for adjusting ejection timing according to claim 1, wherein the predetermined distance corresponds to a circumferential length obtained when a rotating member for changing the relative position has performed a half rotation.

3. A method for adjusting ejection timing according to claim 1, wherein the adjustment patterns are formed in an even number, and the ejection timing is adjusted based on the average of the adjustment amounts determined based on the adjustment patterns in an even number.

4. A method for adjusting ejection timing according to claim 2, wherein the rotating member is a transport roller for transporting the medium in the intersecting direction, and the relative position is changed by rotating the transport roller and transporting the medium.

5. A method for adjusting ejection timing according to claim 2, wherein the rotating member is a roller for moving the first nozzle row and the second nozzle row in the intersecting direction, and the relative position can be changed by rotating the roller and moving the first nozzle row and the second nozzle row.

6. A method for adjusting ejection timing according to claim 1, wherein with respect to the direction of the first nozzle row, each nozzle of the first nozzle row is positioned at the center of two nozzles of the second nozzle row.

7. A method for adjusting ejection timing according to claim 1, wherein the adjustment patterns are formed in a manner in which the landing position of liquid droplets from the second nozzle row is shifted in the intersecting direction with respect to the landing position of liquid droplets from the first nozzle row, as a result of the ejection timing of liquid droplets from the second nozzle row being changed for each nozzle.

8. A method for adjusting ejection timing according to claim 1, wherein the adjustment patterns are formed in a manner in which ink droplets ejected from a predetermined number of nozzles of the first nozzle row and ink droplets ejected from a predetermined number of nozzles of the second nozzle row alternately land with respect to the first nozzle row direction.

9. An ejection timing adjusting apparatus, comprising:

a recording device that forms an adjustment pattern including a plurality of first patterns and a plurality of second patterns on a medium by changing a relative position between first and second nozzle rows and the medium in an intersecting direction that intersects a row direction in which nozzles of the first nozzle row and the second nozzle row are lined up and gradually changing an ejection interval between formation of a first pattern by electing liquid droplets from the first nozzle row and formation of a second pattern by eiectinq liquid droplets from the second nozzle row, the first nozzle row and the second nozzle row being arranged parallel to each other and being separated from each other in the intersecting direction; and an input device that inputs an adjustment amount of relative ejection timing of the first nozzle row and the second nozzle row based on the adjustment pattern, wherein, with the gradually changed ejection timing being maintained, a plurality of the adjustment patterns are formed with a separation of a predetermined distance in the intersecting direction between each other, and the apparatus further includes an arithmetic processing section that obtains the ejection timing based on an average of adjustment amounts inputted based on the adjustment patterns.

10. A recording apparatus comprising:

a first nozzle row;

a second nozzle row;

a changing section that changes a relative position between first and second nozzle rows and a medium in an intersecting direction that intersects a row direction in which nozzles of the first nozzle row and the second nozzle row are lined up;

a controlling section that forms an adjustment pattern including a plurality of the first patterns and the second patterns on the medium by gradually changing an ejection interval between formation of a first pattern by ejecting liquid droplets from the first nozzle row and formation of a second pattern by ejecting liquid droplets from the second nozzle row, wherein the first nozzle row and the second nozzle row are arranged parallel to each other and are separated from each other in the intersecting direction, an adjustment amount of ejection timing of the first nozzle row and the second nozzle row are determined based on the adjustment pattern, with the gradually changed ejection interval being maintained, a plurality of the adjustment patterns are formed with a separation of a predetermined distance in the intersecting direction between each other, and the ejection timing is adjusted based on an average of adjustment amounts determined based on the adjustment patterns.

11. A recording apparatus according to claim 10, wherein the predetermined distance corresponds to a circumferential length obtained when a rotating member for changing the relative position has performed a half rotation.

12. A recording apparatus according to claim 10, wherein the adjustment patterns are formed in an even number, and the ejection timing is adjusted based on the average of the adjustment amounts determined based on the adjustment patterns in an even number.

13. A recording apparatus according to claim 11, wherein the rotating member is a transport roller for transporting the medium in the intersecting direction, and the relative position is changed by rotating the transport roller and transporting the medium.

14. A recording apparatus according to claim 11, wherein the rotating member is a roller for moving the first nozzle row and the second nozzle row in the intersecting direction, and the relative position can be changed by rotating the roller and moving the first nozzle row and the second nozzle row.

15. A recording apparatus according to claim 10, wherein with respect to the direction of the first nozzle row, each nozzle of the first nozzle row is positioned at the center of two nozzles of the second nozzle row.

16. A recording apparatus according to claim 10, wherein the adjustment patterns are formed in a manner in which the landing position of liquid droplets from the second nozzle row is shifted in the intersecting direction with respect to the landing position of liquid droplets from the first nozzle row, as a result of the ejection timing of liquid droplets from the second nozzle row being changed for each nozzle.

17. A recording apparatus according to claim 10, wherein the adjustment patterns are formed in a manner in which ink droplets ejected from a predetermined number of nozzles of the first nozzle row and ink droplets ejected from a predetermined number of nozzles of the second nozzle row alternately land with respect to the first nozzle row direction.

* * * * *